US011085457B2

(12) United States Patent
Oklejas, Jr.

(10) Patent No.: US 11,085,457 B2
(45) Date of Patent: Aug. 10, 2021

(54) THRUST BEARING SYSTEM AND METHOD FOR OPERATING THE SAME

(71) Applicant: Fluid Equipment Development Company, LLC, Monroe, MI (US)

(72) Inventor: Eli Oklejas, Jr., Newport, MI (US)

(73) Assignee: FLUID EQUIPMENT DEVELOPMENT COMPANY, LLC, Monroe, MI (US)

( * ) Notice: Subject to any disclaimer, the term of this patent is extended or adjusted under 35 U.S.C. 154(b) by 0 days.

(21) Appl. No.: 16/573,385

(22) Filed: Sep. 17, 2019

(65) Prior Publication Data

US 2020/0011340 A1 Jan. 9, 2020

Related U.S. Application Data

(63) Continuation-in-part of application No. 15/986,205, filed on May 22, 2018, now Pat. No. 10,801,512.
(Continued)

(51) Int. Cl.
*F04D 29/047* (2006.01)
*F04D 29/58* (2006.01)
(Continued)

(52) U.S. Cl.
CPC ..... *F04D 29/047* (2013.01); *F04D 29/0413* (2013.01); *F04D 29/2266* (2013.01); *F04D 29/5866* (2013.01)

(58) Field of Classification Search
CPC .. F04D 29/047; F04D 29/0413; F04D 29/056; F04D 29/5866; F04D 29/2266; F05D 2260/15; F01D 25/20
See application file for complete search history.

(56) References Cited

U.S. PATENT DOCUMENTS 659,930 A 10/1900 Kemble
893,127 A 7/1908 Barber
(Continued)

FOREIGN PATENT DOCUMENTS

CH 330272 A 5/1958
DE 1094592 B 12/1960
(Continued)

OTHER PUBLICATIONS

International Search Report dated Nov. 27, 2020 in corresponding PCT Application No. PCT/US2020/050207.
(Continued)

*Primary Examiner* — Richard A Edgar
*Assistant Examiner* — Jackson M Gillenwaters
(74) *Attorney, Agent, or Firm* — Harness, Dickey & Pierce, P.L.C.

(57) ABSTRACT

A fluid machine and method of operating the same comprises a pump portion, turbine portion and a center bearing therebetween. The method includes communicating lubricant to a thrust bearing cavity disposed between a turbine impeller and a thrust wear ring, communicating lubricant from the thrust bearing cavity to a center axial shaft passage of a shaft through an impeller passage of the turbine impeller, communicating lubricant through the axial shaft passage to a bearing clearance between a shaft and a center bearing through a first radial shaft passage and a second radial shaft passage and communicating lubricant through the bearing clearance to a pump impeller chamber and a turbine impeller chamber.

35 Claims, 14 Drawing Sheets

Related U.S. Application Data

(60) Provisional application No. 62/735,868, filed on Sep. 25, 2018, provisional application No. 62/509,914, filed on May 23, 2017.

(51) Int. Cl.
*F04D 29/22* (2006.01)
*F04D 29/041* (2006.01)

(56) References Cited

U.S. PATENT DOCUMENTS 1,022,683 A 4/1912 Kienast
1,024,111 A 4/1912 Anderson
1,066,581 A 7/1913 Brown
1,146,078 A 7/1915 Oklejas, Jr.
1,323,412 A 12/1919 Schorr
1,654,907 A 1/1928 Wood
2,449,297 A 9/1948 Hoffer
2,715,367 A 8/1955 Kodet
2,717,182 A 9/1955 Goddard
2,748,714 A 6/1956 Henry
3,160,108 A 12/1964 Sence
3,220,349 A 11/1965 White
3,563,618 A 2/1971 Ivanov
3,614,259 A 10/1971 Neff
3,664,758 A 5/1972 Sato
3,671,137 A 6/1972 Ball
3,748,057 A 7/1973 Eskeli
3,828,610 A 8/1974 Swearingen
3,969,804 A 7/1976 MacInnes et al.
3,999,377 A 12/1976 Oklejas et al.
4,028,885 A 6/1977 Ganley et al.
4,029,431 A 6/1977 Bachl
4,187,173 A 2/1980 Keefer
4,230,564 A 10/1980 Keefer
4,243,523 A 1/1981 Pelmulder
4,255,081 A 3/1981 Oklejas et al.
4,288,326 A 9/1981 Keefer
4,353,874 A 10/1982 Keller et al.
4,432,876 A 2/1984 Keefer
4,434,056 A 2/1984 Keefer
4,472,107 A 9/1984 Chang et al.
RE32,144 E 5/1986 Keefer
4,632,756 A 12/1986 Coplan et al.
4,702,842 A 10/1987 Lapierre et al.
4,830,572 A 5/1989 Oklejas, Jr. et al.
4,867,633 A 9/1989 Gravelle
4,966,708 A 10/1990 Oklejas et al.
4,973,408 A 11/1990 Keefer
4,983,305 A 1/1991 Oklejas et al.
4,997,357 A 3/1991 Eirich et al.
5,020,969 A 6/1991 Mase et al.
5,049,045 A 9/1991 Oklejas et al.
5,082,428 A 1/1992 Oklejas et al.
5,106,262 A 4/1992 Oklejas et al.
5,132,090 A 7/1992 Volland
5,133,639 A 7/1992 Gay et al.
5,154,572 A 10/1992 Toyoshima et al.
5,163,812 A 11/1992 Klaus
5,320,755 A 6/1994 Hagqvist et al.
5,338,151 A 8/1994 Kemmner et al.
5,340,286 A 8/1994 Kanigowski
5,482,441 A 1/1996 Permar
5,499,900 A 3/1996 Khmara et al.
5,702,229 A 12/1997 Moss et al.
5,819,524 A 10/1998 Bosley et al.
5,951,169 A 9/1999 Oklejas et al.
5,980,114 A 11/1999 Oklejas, Jr.
5,993,173 A * 11/1999 Koike ..... F16C 17/10 417/407
6,007,723 A 12/1999 Ikada et al.
6,017,184 A * 1/2000 Aguilar ..... F04D 29/26 415/112
6,017,200 A 1/2000 Childs et al.
6,036,435 A 3/2000 Oklejas
6,071,091 A 6/2000 Lemieux
6,110,375 A 8/2000 Bacchus et al.
6,116,851 A 9/2000 Oklejas, Jr.
6,120,689 A 9/2000 Tonelli et al.
6,139,740 A 10/2000 Oklejas
6,187,200 B1 2/2001 Yamamura et al.
6,190,556 B1 2/2001 Uhlinger
6,309,174 B1 10/2001 Oklejas, Jr. et al.
6,345,961 B1 2/2002 Oklejas, Jr.
6,468,431 B1 10/2002 Oklelas, Jr.
6,589,423 B1 7/2003 Chancellor
6,713,028 B1 3/2004 Oklejas, Jr.
6,797,173 B1 9/2004 Oklejas, Jr.
6,881,336 B2 4/2005 Johnson
6,932,907 B2 8/2005 Haq et al.
7,077,962 B2 7/2006 Pipes
7,150,830 B1 12/2006 Katsube et al.
7,517,154 B2 * 4/2009 McKeirnan, Jr. ..... F16C 19/548 384/519
8,016,545 B2 9/2011 Oklejas, Jr.
8,529,191 B2 9/2013 Oklejas, Jr.
8,790,072 B2 * 7/2014 Boldt ..... F04D 29/047 415/112
9,470,240 B2 10/2016 Uneura
9,677,569 B2 6/2017 Hunt
10,473,207 B2 11/2019 Nishioka et al.
2003/0080058 A1 5/2003 Kimura et al.
2004/0211729 A1 10/2004 Sunkara et al.
2006/0157409 A1 7/2006 Hassan
2006/0157410 A1 7/2006 Hassan
2006/0226077 A1 10/2006 Stark
2007/0056907 A1 3/2007 Gordon
2007/0199878 A1 8/2007 Eisberg et al.
2007/0289904 A1 12/2007 Oklejas
2007/0292283 A1 12/2007 Oklejas
2007/0295650 A1 12/2007 Yoneda et al.
2014/0265692 A1 * 9/2014 Schneider ..... F04D 29/047 310/104
2015/0240828 A1 8/2015 Hunt
2015/0292562 A1 * 10/2015 Maeda ..... F02C 7/06 384/280
2016/0177963 A1 6/2016 Danguy et al.

FOREIGN PATENT DOCUMENTS

DE 1936121 A1 1/1971
DE 3510160 A1 9/1986
EP 0547279 A1 6/1993
EP 0952352 A2 10/1999
EP 1508361 A1 2/2005
EP 1717449 A2 11/2006
EP 1798419 A2 6/2007
EP 2302201 A2 3/2011
FR 2624226 A1 6/1989
FR 2775321 A1 8/1999
GB 2363741 A 1/2002
WO WO-02/09855 A1 2/2002
WO WO-06/106158 A1 10/2006
WO WO-07/146321 A1 12/2007
WO WO-2010091036 A1 8/2010
WO WO-2019155797 A1 8/2019

OTHER PUBLICATIONS

El-Sayed, E., et al.: "Performance evaluation of two RO membrane configurations in a MSF/RO hybrid system"; Desalination, Elsevier, Amsterdam, NL, vol. 128, No. 3, May 1, 2000 (May 1, 2000). pp. 231-245, SP004204830; ISSN: 0011-9164; pp. 232-234; figure 1.
Geisler, P., et al.: Reduction of the energy demand for seawater RO with the pressure exchange system PES:; Desalination, Elsevier, Amsterdam, NL, vol. 135, No. 1-3, Apr. 20, 2001 (Apr. 20, 2001), pp. 205-210, SP004249642; ISSN: 0011-9164; the whole document.
International Search Report Completed Jul. 24, 2018.

(56) References Cited

OTHER PUBLICATIONS

Office Action issued in counterpart Canadian Application No. 3,056,662, dated Dec. 23, 2020.

* cited by examiner

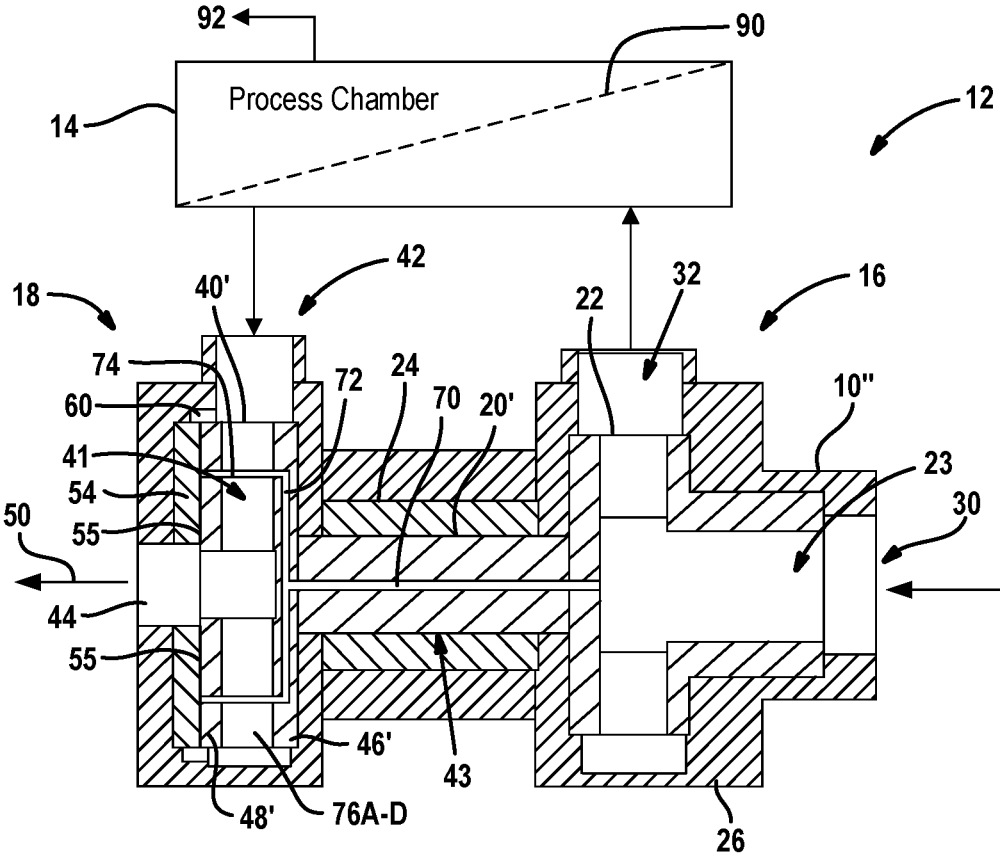
FIG. 2
Prior Art
FIG. 3
Prior Art
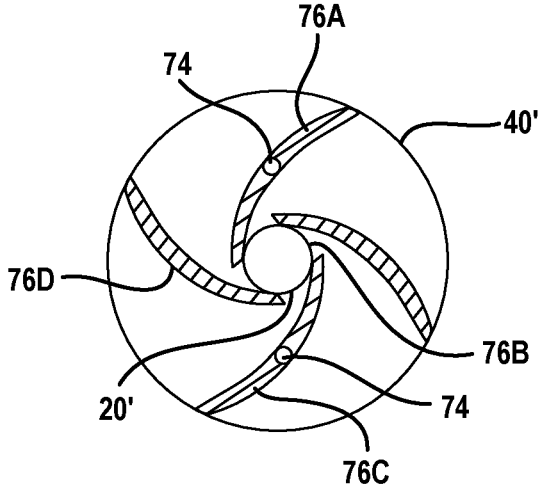

THRUST BEARING SYSTEM AND METHOD FOR OPERATING THE SAME

CROSS-REFERENCE TO RELATED APPLICATIONS

This application claims the benefit of U.S. Provisional Application No. 62/735,868 filed on Sep. 25, 2018 and is a continuation-in-part of Ser. No. 15/986,205 which claims the benefit of U.S. Provisional Application No. 62/509,914 filed on May 23, 2017. The disclosures of the above application incorporated herein by reference.

TECHNICAL FIELD

The present disclosure relates generally to a fluid machine, and, more specifically, to thrust bearing lubrication for axial thrust force compensation within the fluid machine suitable for high contaminant or gas bubble environments.

BACKGROUND

The statements in this section merely provide background information related to the present disclosure and may not constitute prior art.

Rotating fluid machines are used in many applications for many processes. Lubrication for a rotating fluid machine is important. Various types of fluid machines use a thrust bearing that is lubricated by the pumpage. Adequate flow of pumpage should be supplied to obtain proper lubrication. Fluid machines are used under various conditions. During normal operating conditions, lubrication may be relatively easy. However, under various operating conditions contaminants or bubbles may be present in the pumpage. Contaminants and pumpage may affect the lubrication provided by the thrust bearing. Losing lubrication may cause damage the fluid machine. Air entrainment or debris within the pumpage may cause upset conditions.

Referring now to FIG. 1, a hydraulic pressure booster (HPB) 10 is one type of fluid machine. The hydraulic pressure booster 10 is part of an overall processing system 12 that also includes a process chamber 14. Hydraulic pressure boosters may include a pump portion 16 and a turbine portion 18. A common shaft 20 extends between the pump portion 16 and the turbine portion 18. The HPB 10 may be free-running which means that it is solely energized by the turbine and will run at any speed where the equilibrium exists between a turbine output torque and the pump input torque. The rotor or shaft 20 may also be connected to an electric motor to provide a predetermined rotational rate.

The hydraulic pressure booster 10 is used to boost the process feed stream using energy from another process stream which is depressurized through the turbine portion 18.

The pump portion 16 includes a pump impeller 22 disposed within a pump impeller chamber 23. The pump impeller 22 is coupled to the shaft 20. The shaft 20 is supported by a bearing 24. The bearing 24 is supported within a casing 26. Both the pump portion 16 and the turbine portion 18 may share the same casing structure.

The pump portion 16 includes a pump inlet 30 for receiving pumpage and a pump outlet 32 for discharging fluid to the process chamber 14. Both of the pump inlet 30 and the pump outlet 32 are openings within the casing 26.

The turbine portion 18 may include a turbine impeller 40 disposed within a turbine impeller chamber 41. The turbine impeller 40 is rotatably coupled to the shaft 20. The pump impeller 22, the shaft 20 and the turbine impeller 40 rotate together to form a rotor 43. Fluid flow enters the turbine portion 18 through a turbine inlet 42 through the casing 26. Fluid flows out of the turbine portion 40 through a turbine outlet 44 also through the casing 26. The turbine inlet 42 receives high-pressure fluid and the outlet 44 provides fluid at a pressure reduced by the turbine impeller 40.

The impeller 40 is enclosed by an impeller shroud. The impeller shroud includes an inboard impeller shroud 46 and an outboard impeller shroud 48. During operation the pump impeller 22, the shaft 20 and the turbine impeller 40 are forced in the direction of the turbine portion 18. In FIG. 1, this is in the direction of the axial arrow 50. The impeller shroud 48 is forced in the direction of a thrust bearing 54.

The thrust bearing 54 may be lubricated by pumpage fluid provided from the pump inlet 30 to the thrust bearing 54 through an external tube 56. A gap or layer of lubricating fluid may be disposed between the thrust bearing 54 and outboard impeller shroud which is small and is thus represented by the gap 55 therebetween. A filter 58 may be provided within the tube to prevent debris from entering the thrust bearing 54. At start-up, the pressure in the pump portion 16 is greater than the thrust bearing and thus lubricating flow will be provided to the thrust bearing 54. During operation, the pressure within the turbine portion 18 will increase and thus fluid flow to the thrust bearing 54 may be reduced. The thrust bearing 54 may have inadequate lubricating flow during operation. Also, when the filter 58 becomes clogged, flow to the thrust bearing 54 may be interrupted. The thrust bearing 54 generates a force during normal operation in the opposite direction of arrow 50.

Referring now to FIG. 2, a first example of a hydraulic-pressure booster 10" is illustrated. In this example, the common components from FIG. 1 are provided with the same reference numerals are not described further. In this example, a hollow shaft 20' is used rather than the solid shaft illustrated in FIG. 1. The hollow shaft 20' has a shaft passage 70 that is used for passing pumpage from the pump impeller chamber 23 of the pump portion 16 to the turbine portion 18. The passage 70 may provide pumpage from the pump inlet 30.

The inboard shroud 46' includes radial passages 72. The radial passages 72 are fluidically coupled to the shaft passage 70. Although only two radial passages 72 are illustrated, multiple radial passages may be provided.

The impeller 40' may include vanes 76A-D as is illustrated in FIG. 3. The impeller 40' includes axial passages 74. The axial passages 74 may be provided through vanes 76A and 76C of the impeller 40'. The axial passages are parallel to the axis of the HPB 10" and the shaft 20'. The axial passages 74 extend partially through the inner impeller shroud 46' and entirely through the outboard impeller shroud 48'. The axial passages 74 terminate adjacent to the thrust bearing 54. Again the gap 55 between the outboard impeller shroud 48' and the thrust bearing 54 is small and thus is represented by a line in the Figure. The lubrication path for the thrust bearing 54 includes the shaft passage 70, the radial passages 72 and the axial turbine impeller passages 74.

In operation, at start-up pressure within the pump portion 16 is higher than the turbine portion 18. Fluid within the pump portion travels through the shaft passage 70 to the radial passages 72 and to the axial passage 74. When the fluid leaves the axial passage 74, the fluid is provided to the thrust bearing 54. More specifically, the fluid lubricates the space or gap 55 between the thrust bearing 54 and the outboard impeller shroud 48'. The thrust bearing 54 generates an inboard axial force in response to the lubricating fluid in the opposite direction of arrow 50.

The highest pressure in the pumpage occurs in the pump inlet 30 during startup. Passages downstream of the pump inlet are at lower pressure and thus fluid from the pump portion 16 flows to the turbine portion 18. Consequently, pumpage from the inlet is high during the startup. During shutdown of the equipment, the same factors apply due to the differential and pressure between the pump and the turbine. During normal operation, the highest pressure is no longer in the pump inlet but is at the pump outlet 32. Due to the arrangement of the lubrication passages, the pressure increases in the pumpage due to a pressure rise occurring in the radial passage 72 due to a centrifugal force generated by the rotation of the turbine impeller 40'. The amount of pressure generation is determined by the radial length of the radial passages 72 and the rate of the rotor rotation. Consequently, pumpage is provided to the thrust bearing at the startup, normal operation and shutdown of the hydraulic pressure booster 10".

Referring now to FIG. 3, the impeller 40' is illustrated having four impeller vanes 76A-76D. Various numbers of vanes may be provided. The vanes extend axially relative to the axis of the shaft 20'. More than one impeller vane may have an axial passage 74. The axial passage 74 extends through the vanes 76 and the inboard impeller shroud 46' sufficient to intercept radial passage 72 and the outboard impeller shroud 48' which are illustrated in FIG. 2.

It should be noted that the process chamber 14 is suitable for various types of processes including a reverse osmosis system. For a reverse osmosis system, the process chamber may have a membrane 90 disposed therein. A permeate output 92 may be provided within the process chamber for desalinized fluid to flow therefrom. Brine fluid may enter the turbine inlet 42. Of course, as mentioned above, various types of process chambers may be provided for different types of processes including natural gas processing and the like.

Referring now to FIG. 4, an example similar to that of FIG. 2 is illustrated and is thus provided the same reference numerals. In this example, a hydraulic pressure booster 10''' having a deflector 110 is provided within the pump inlet 30. The deflector 110 may be coupled to the pump impeller 22 using struts 112. The struts 112 may hold the deflector 110 away from the pump impeller so that a gap is formed therebetween that allows fluid to flow into the shaft passage 70.

The deflector 110 may be cone-shaped and have an apex 114 disposed along the axis of the shaft 20'. The cone shape of the deflector 110 will deflect debris in the pumpage into the pump impeller 22 and thus prevent passage of debris into the shaft passage 70. Unlike the filter 58 illustrated in FIG. 1, the debris is deflected away from the shaft passage 70 and thus will not clog the shaft passage 70.

Referring now to FIG. 5, the turbine portion 18 is illustrated having another example of a thrust bearing 54'. The thrust bearing 54' may include an outer land 210 and an inner land 212. A fluid cavity 214 is disposed between the outer land 210, the inner land 212 and the outer shroud 48'. It should be noted that the thrust bearing 54' of FIG. 5 may be included in the examples illustrated in FIGS. 2 and 4.

The outer land 210 is disposed adjacent to the annular clearance 60. The inner land 212 is disposed adjacent to the turbine outlet 44. The thrust bearing 54' may be annular in shape and thus the outer land 210 and inner land 212 may also be annular in shape.

The cavity 214 may receive pressurized fluid from the pump portion 16 illustrated in FIGS. 2 and 4. That is, pumpage may be received through the shaft passage 70, the radial passages 72 and the axial passages 74.

Slight axial movements of the shaft 20 in the attached impeller shroud 48' may cause variations in the axial clearance 220 between the lands 210 and 212 relative to the outer shroud 48'. If the axial clearances 220 increase, the pressure in the fluid cavity 214 decreases due to an increase of leakage through the clearances 220. Conversely, if the axial gap of the clearance 220 decreases, the pressure will rise in the fluid cavity 214. The pressure variation counteracts the variable axial thrust generated during operation and ensures that the lands 210 and 212 do not come into contact with the impeller shroud 48'.

The reduction in pressure is determined by the flow resistance in the passages 70-74. The passages are sized to provide a relationship between the rate of leakage and the change in pressure in the fluid cavity 214 as a function of the axial clearance. The radial location of the passage 74 determines the amount of centrifugally generated pressure rise and is considered in ensuring an optimal leakage in addition to the diameters of the flow channel. Excessive leakage flow may impair the efficiency and insufficient fluid flow will allow clearances to be too small and allow frictional contact during operation.

The pressure in the fluid cavity is higher than the turbine outlet 44 and the pressure in the outer diameter of the impeller in the annular clearance 60 when the passage 74 is at the optimal radial location. Leakage will thus be out of cavity 214 to allow a desired pressure variation within the fluid cavity 214.

Referring now to FIG. 6A, an example similar to that of FIG. 5 is illustrated. The inner land 212 is replaced by a bushing 230. The bushing 230 may form a cylindrical clearance relative to the impeller wear ring 232. The fluid cavity 214 is thus defined between the wear ring 232, the bushing 230 and the outer land 210.

Referring now to FIG. 6B, vane 240 of an impeller 242 having curvature in the axial plane as well as the radial plane is illustrated. The impeller 242 may be used in a mixed flow design. In this example, the outer land 210' and inner land 212' are formed according to the shape of the impeller 242. The fluid cavity 214' may also be irregular in shape between the outer land 210' and the inner land 212'.

The fluid passage 250 provides fluid directly to the fluid cavity 214' in a direction at an angle to the longitudinal axis of the fluid machine and shaft 20'. Thus, the radial passages 72 and axial passages 74 are replaced with the diagonal passage 250. The diagonal passage 250 may enter the fluid cavity 214' at various locations including near the land 212' or at another location such as near land 210'. Various places between land 210' and 212' may also receive the diagonal passage 250.

Referencing now to FIG. 7, another example of a hydraulic pressure booster $\mathbf{10}^{IV}$ is set forth. In this example, the center bearing 24 provides radial support for the shaft $\mathbf{20}^{IV}$ that has a central axial shaft passage 710. The central axial shaft passage 710 communicates fluid from the pump portion 16 to the turbine portion 18. In particular, the central axial shaft passage 710 communicates fluid to an impeller passage having radial extending passages 720 disposed in a first shroud portion 46 of the impeller 40. The impeller 40 and a second shroud portion 48 are located on the axial ends thereof. The radially extending passages 720 fluidically communicate with axially extending passages 726. The axially extending passages 726 fluidically communicate with a thrust bearing 728. The thrust bearing 728 is defined as being a rotating thrust face 730 of the second shroud portion 48, a stationary thrust face 732 of the thrust wear ring 734. The thrust wear ring 734 is disposed around the turbine outlet 44. The thrust bearing 728 is also defined by an inner land 736 and an outer land 738.

The turbine impeller 40 has vanes 724 that have the axially extending passages disposed therein.

Further areas of applicability will become apparent from the description provided herein. It should be understood that the description and specific examples are intended for purposes of illustration only and are not intended to limit the scope of the present disclosure.

SUMMARY

This section provides a general summary of the disclosure, and is not a comprehensive disclosure of its full scope or all of its features.

The present disclosure provides an improved method for lubricating a rotating process machine during operation. The system provides pumpage to the thrust bearing over the entire operating range of the device.

In one aspect of the disclosure, a fluid machine comprises a pump portion having a pump impeller chamber, a pump inlet and a pump outlet, a turbine portion having a turbine impeller chamber, a turbine inlet and a turbine outlet and a shaft extending between the pump impeller chamber and the turbine impeller chamber. The fluid machine also includes a first bearing and a second bearing spaced apart to form a balance disk chamber. A balance disk is coupled to the shaft and is disposed within the balance disk chamber and a turbine impeller coupled to the impeller end of the shaft disposed within the impeller chamber. A first thrust bearing is formed between the balance disk and the first bearing. The thrust bearing receives fluid from at least one of the pump inlet or the turbine outlet.

In another aspect of the disclosure, a method for operating a fluid machine includes communicating fluid from a pump outlet or a turbine inlet to a thrust bearing formed by a balance disk coupled to a shaft, rotating the balance disk between a first bearing and a second bearing, and generating an axial force in response to communicating fluid in response to communicating and generating.

In another aspect of the disclosure, a fluid machine assembly comprises a pump portion having a pump impeller chamber, a pump inlet and a pump outlet. A turbine portion has a turbine impeller chamber, a turbine inlet and a turbine outlet. A center bearing is disposed between the pump impeller chamber and turbine impeller chamber. The center bearing has a first end surface defining a stationary thrust face within the pump impeller chamber. A shaft extends between the pump impeller chamber and the turbine impeller chamber through the center bearing. A turbine impeller is coupled to the shaft disposed within the turbine impeller chamber. A pump impeller is coupled to the shaft and disposed within the pump impeller chamber. The pump impeller comprises a rotating thrust face opposite the stationary thrust face. A land is disposed between the stationary thrust face and the rotating thrust face. The center bearing defines a distribution groove disposed at least partially around the shaft. A feed supply couples the pump outlet to the distribution groove. A thrust bearing comprises a thrust bearing cavity defined between the stationary thrust face, the rotating thrust face and the land. The thrust bearing receives filtered fluid from the pump outlet. A first bearing clearance through the center bearing fluidically couples the distribution groove to the thrust bearing cavity. A second bearing clearance through the center bearing fluidically couples the distribution groove to the turbine impeller chamber.

In another aspect of the disclosure, method of operating a fluid machine comprises communicating fluid from a pump outlet to a distribution groove disposed in a center bearing, communicating fluid from the distribution groove to a thrust bearing formed between a stationary end surface of a center bearing and an end surface of a pump shroud that is coupled to a shaft, rotating the shaft to generate a first axial force, and generating a second axial force counter to the first axial force in response to communicating fluid from the distribution groove to the thrust bearing.

In another aspect of the invention, a fluid machine assembly includes a casing comprising a pump portion having a pump impeller chamber, a pump inlet and a pump outlet. A pump impeller is disposed in the pump impeller chamber. The casing further comprises a turbine portion having a turbine inlet, a turbine outlet and a turbine impeller chamber. A turbine impeller is disposed in the turbine impeller chamber. The turbine impeller comprises a turbine shroud having a rotating thrust face. A shaft extends between the pump impeller and the turbine impeller. The shaft comprises a center axial shaft passage, a first radial shaft passage and a second radial shaft passage. A turbine wear ring is disposed around the turbine outlet comprising a stationary thrust face opposite the rotating thrust. A center bearing is disposed around the shaft between the pump impeller chamber and turbine impeller chamber. The center bearing and the shaft comprise a bearing clearance therebetween. A land is disposed between the stationary thrust face and the rotating thrust face. A thrust bearing comprising a thrust bearing cavity defined between the stationary thrust face, the rotating thrust face and the land. The thrust bearing receives filtered fluid from the pump outlet. A lubricant supply couples lubricant to the thrust bearing cavity. An impeller passage communicates lubricant from the thrust bearing cavity to the center axial shaft passage. The axial shaft passage communicates lubricant to the bearing clearance through the first radial shaft passage and the second radial shaft passage. The bearing clearance communicates lubricant to the pump impeller chamber and the turbine impeller chamber.

In yet another aspect of the invention, a method includes communicating lubricant to a thrust bearing cavity disposed between a turbine impeller and a thrust wear ring, communicating lubricant from the thrust bearing cavity to a center axial shaft passage of a shaft through an impeller passage of the turbine impeller, communicating lubricant through the axial shaft passage to a bearing clearance between a shaft and a center bearing through a first radial shaft passage and a second radial shaft passage and communicating lubricant through the bearing clearance to a pump impeller chamber and a turbine impeller chamber.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

FIG. 2 is a cross-sectional view of a first fluid machine according to the prior art.

FIG. 3 is an end view of an impeller of FIG. 2.

DETAILED DESCRIPTION

Figure 1:
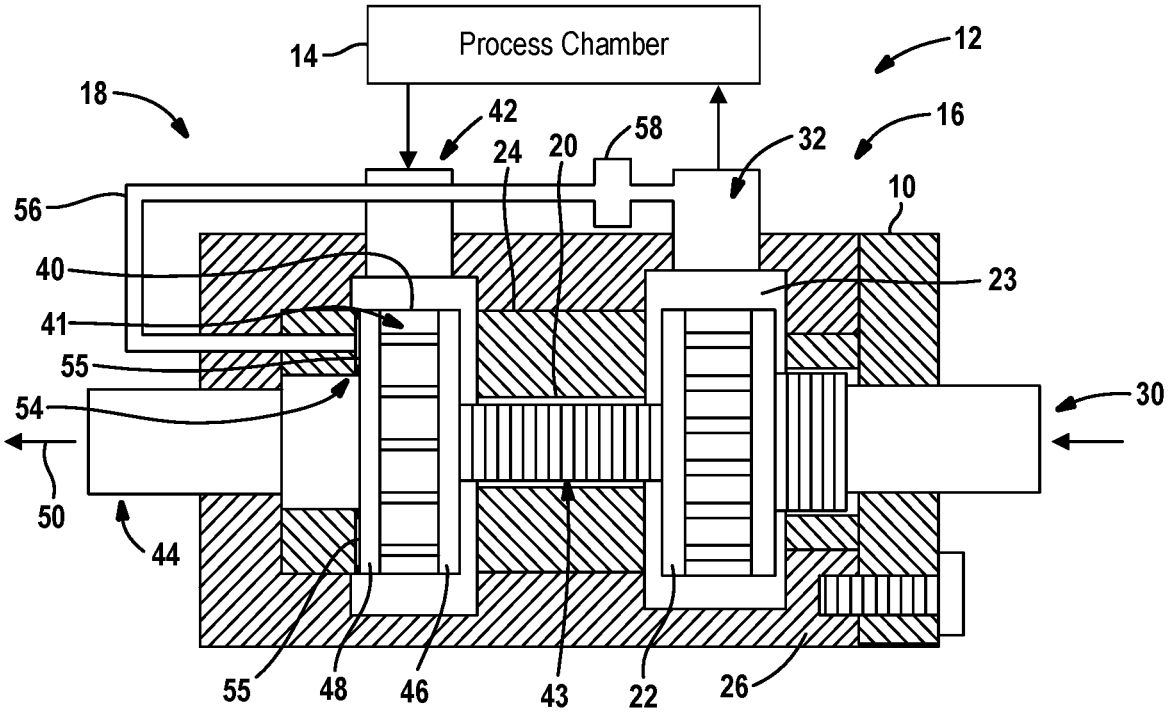
FIG. 1 Prior Art
FIG. 1 is a cross-sectional view of a first turbocharger according to the prior art.
Figure 4:
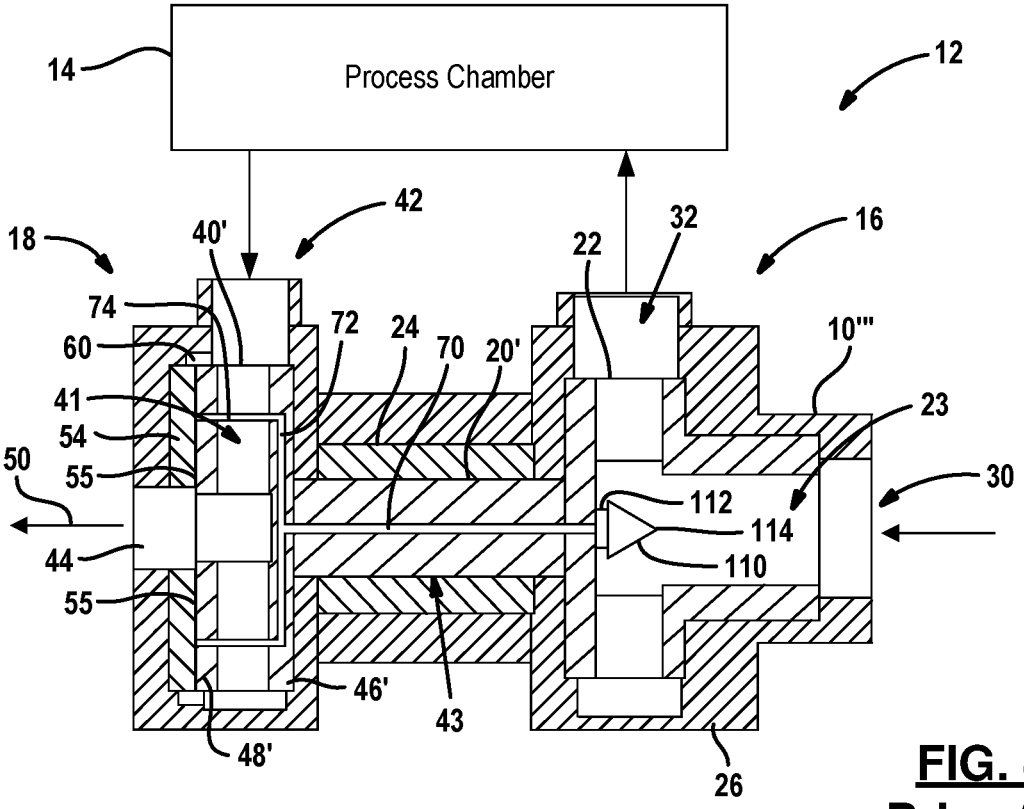
FIG. 4 Prior Art
FIG. 4 is a cross-sectional view of a second fluid machine according to the prior art.
Figure 5:
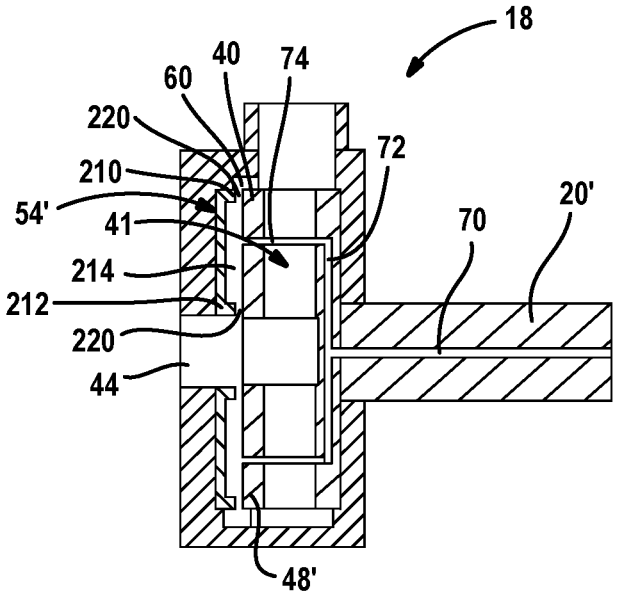
FIG. 5 Prior Art
FIG. 5 is a cross-sectional view of a third example of a turbine portion according to the prior art.
Figure 6A:
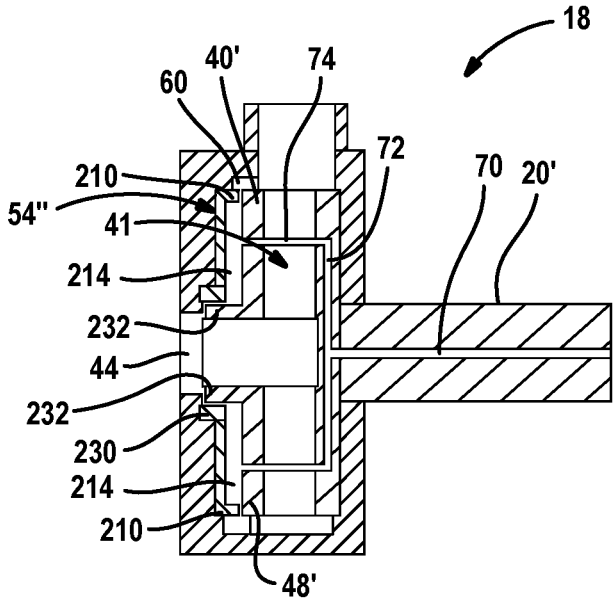
FIG. 6A Prior Art
FIG. 6A is a cross-sectional view of a fourth example of a turbine portion according to the prior art.
Figure 6B:
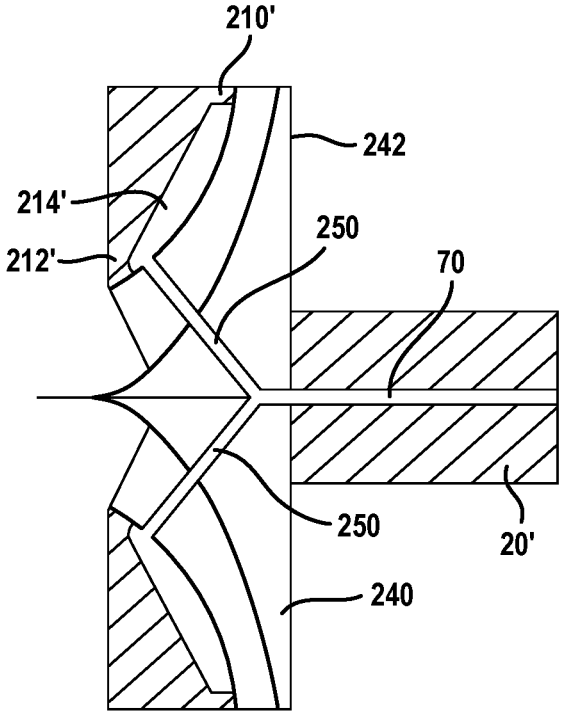
FIG. 6B Prior Art
FIG. 6B is a cross-sectional view of an alternative example of an impeller of the prior art.

The following description is merely exemplary in nature and is not intended to limit the present disclosure, application, or uses. For purposes of clarity, the same reference numbers will be used in the drawings to identify similar elements. As used herein, the phrase at least one of A, B, and C should be construed to mean a logical (A or B or C), using a non-exclusive logical OR. It should be understood that steps within a method may be executed in different order without altering the principles of the present disclosure.

In the following description, a hydraulic pressure booster having a turbine portion and pump portion is illustrated. However, the present disclosure applies equally to other fluid machines. The present disclosure provides a way to deliver pumpage to a thrust bearing over the operating range of the device. Debris entering the turbine is also reduced.

Figure 7:
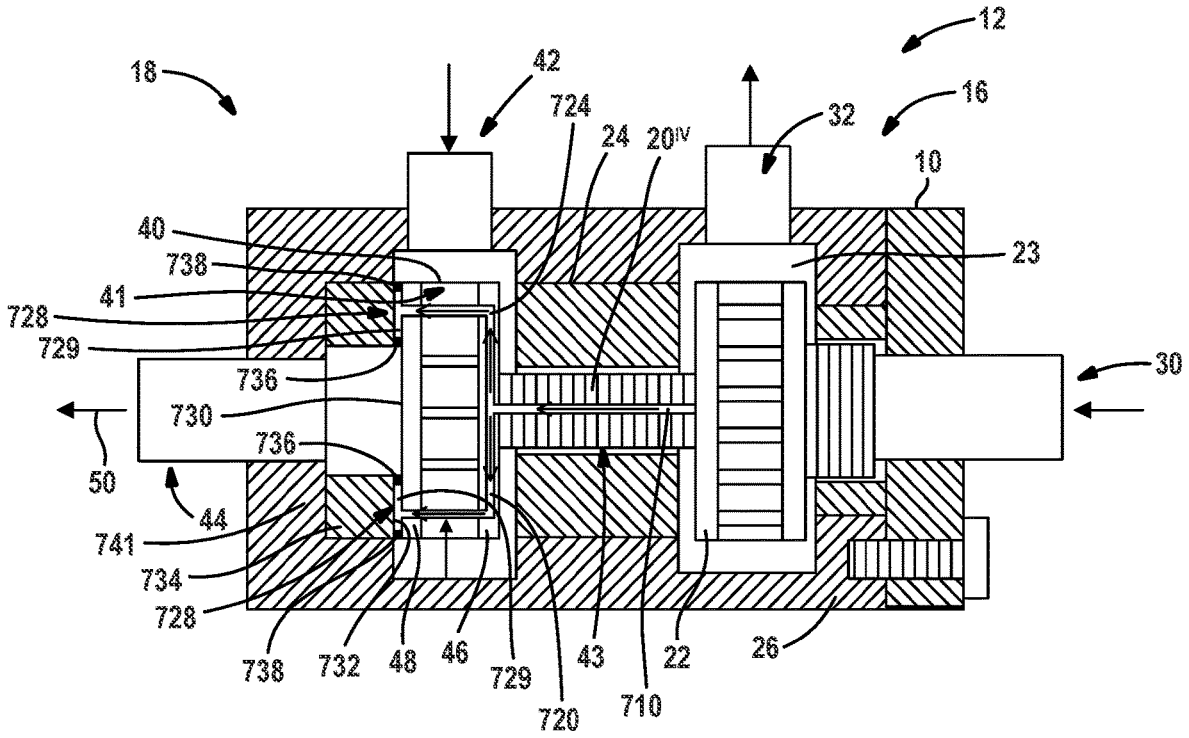
FIG. 7 Prior Art
FIG. 7 is a cross-sectional view of a fifth example of a turbine having an axial lubrication system of the prior art.
Figure 8A:
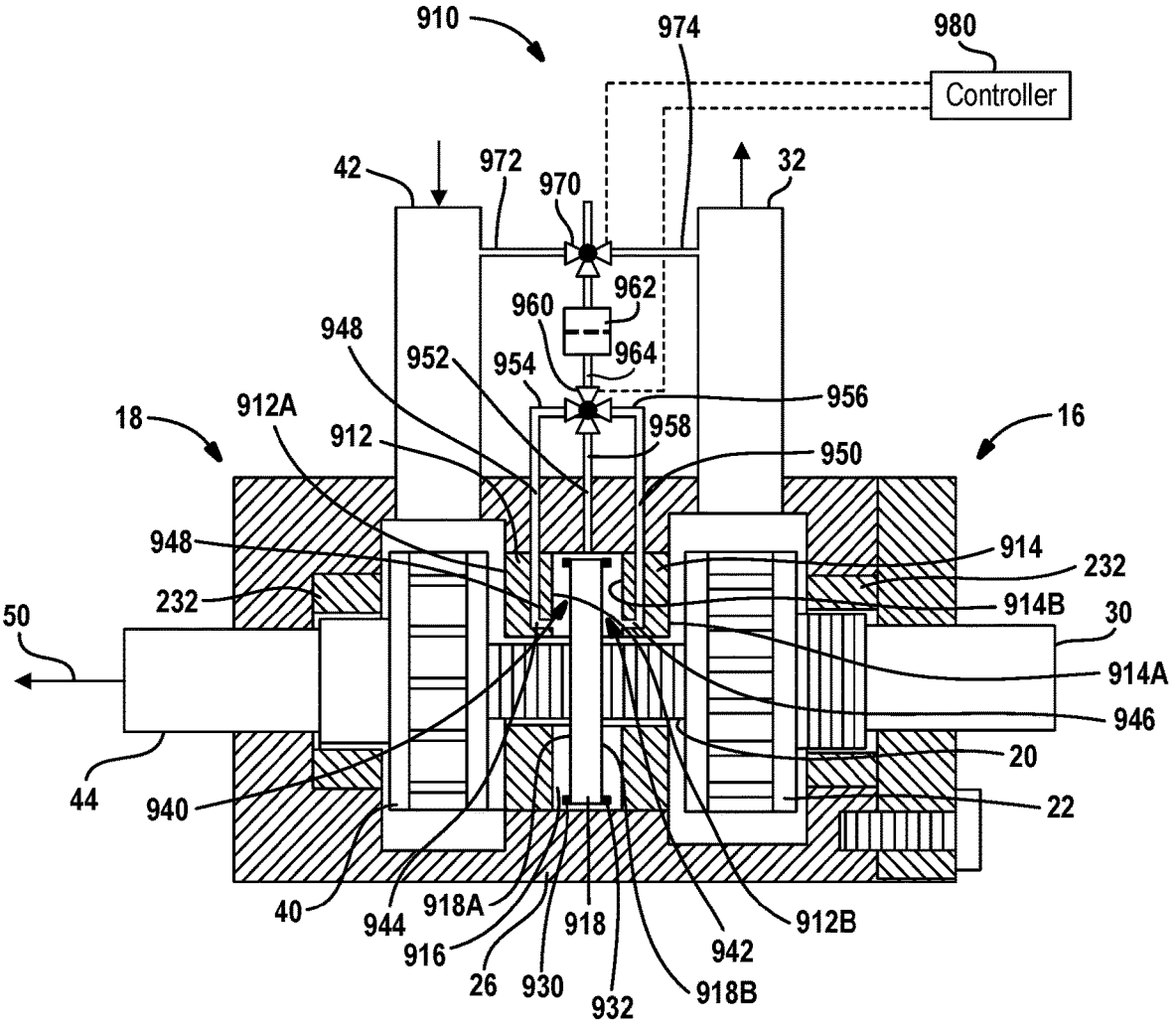
FIG. 8A is a cross-sectional view of a first example according to the present disclosure.

Referring now to FIG. 8A, a fluid machine such as a hydraulic pressure booster 910 according to the present disclosure is set forth. In this example, the components with the same reference numerals described above in FIGS. 1-7 are set forth. In this example, the hydraulic pressure booster 910 includes a first bearing 912 and a second bearing 914 that are spaced apart. In this example, the bearing 912 may be referred to as a turbine bearing and the bearing 914 may be referred to as a pump bearing. The pump bearing 914 and turbine bearing 912 define a balance disk chamber 916. The balance disk chamber 916 houses a balance disk 918 which is rotatably coupled to the common shaft 20. The bearing 912 has a first side 912A that is disposed adjacent to the turbine impeller 40 and a second surface 912B within the balance disk chamber 916. The bearing 914 has a first side 914A adjacent to the pump impeller 22 and a second side 914B within the balance disk chamber 916. The bearings 912 and 914 provide radial support for the shaft 920. The turbine outlet 44 is coaxial with the shaft 20.

The balance disk 918 has a first side or surface 918A that faces surface 912B and a second surface 918B that faces the second surface 914B. Surface 918A has a land 930. The second surface 918B has a second land 932. The lands 930 and 932 are annular in shape. In an alternate example, the land 930 may be disposed on the surface 912B. Land 932 may also be disposed on the surface 914B.

A first thrust bearing 940 is defined by the volume between the surface 912B, surface 918A and the first land 930. A second thrust bearing 942 is defined between the surface 914B, surface 918B and the land 932. The thrust bearing and the land 932. The thrust bearings 940, 942 are provided with process fluid from either the turbine flow or the feed flow as will be defined below. Fluid is communicated to the first thrust bearing 940 through an inlet port 944. Fluid is communicated to the second thrust bearing 942 through a port 946. The port 944 is in fluid communication with a channel 948 that extends through the bearing 912 and the casing 26. A channel 950 is in fluid communication with the port 946 through the bearing 914 and the casing 26. Another channel 952 may extend through the casing 26 and provide fluid adjacent to the balance disk 918.

A first pipe 954 may communicate fluid to the first channel 948. A second pipe 956 communicates processed fluid to the channel 950. Pipe 958 communicates fluid to the channel 950.

Each of the pipes 954, 956 and 958 may be in communication with a four-way valve 960. The four-way valve 960 selectively communicates fluid to the pipes 954-956. It should be noted that the four-way valve 960 may receive fluid from a filter 962. The filter 962 filters out contaminants from the process fluid before reaching the pipes 954-958. Fluid from the filter 962 is communicated through a pipe 964.

In operation, the four-way valve 960 may be eliminated if the hydraulic pressure booster 910 is used in one or selected operating conditions. That is, the loads acting on the shaft from the turbine impeller 40 or the pump impeller 22 may always act in a constant direction during operation. Thus, one of the channels 948-952 may be provided in the design while eliminating the others.

A three-way valve 970 is in communication with the turbine inlet 42 and the pump outlet 32 through pipes 972 and 974, respectively.

In operation, a counter thrust to balance the thrust of the rotor is provided with the balance disk 918 and the thrust bearings 940 and 942 associated therewith. As mentioned above, only one thrust bearing need be formed in certain design conditions. When the thrust indicated by arrow 50, which is toward the turbine portion, is present, lubrication flow may be admitted through the pipe 954 and into the channel 948 where it enters to form a thrust bearing through the port 944. Fluid enters the pipe through the four-way valve 960, the pipe 958 and the filter 962. Fluid may be communicated into the filter 962 through the three-way valve 970 which operates to provide fluid from either the turbine inlet 42 or the pump outlet 32. The three-way valve 970 may be controlled by a controller 980 which may be microprocessor-based. The controller 980 may also control the operation of the four-way valve 960.

If the thrust is directed toward the pump side of the HPB 910, lubrication flow may be admitted through channel 950 and pipe 956. Fluid is communicated through the four-way valve 960, the three-way valve 970 and from one of the turbine inlet 42 or the pump outlet 32.

As briefly mentioned above, it may also be desirable to communicate fluid simultaneously through the pipes 954 and 958. Likewise, it may be desirable to communicate fluid through pipes 956 and 958. The pipe 958 communicates fluid to the channel 952. The channel 952 provides fluid adjacent to the peripheral edge of the balance disk 918.

Figure 8B:
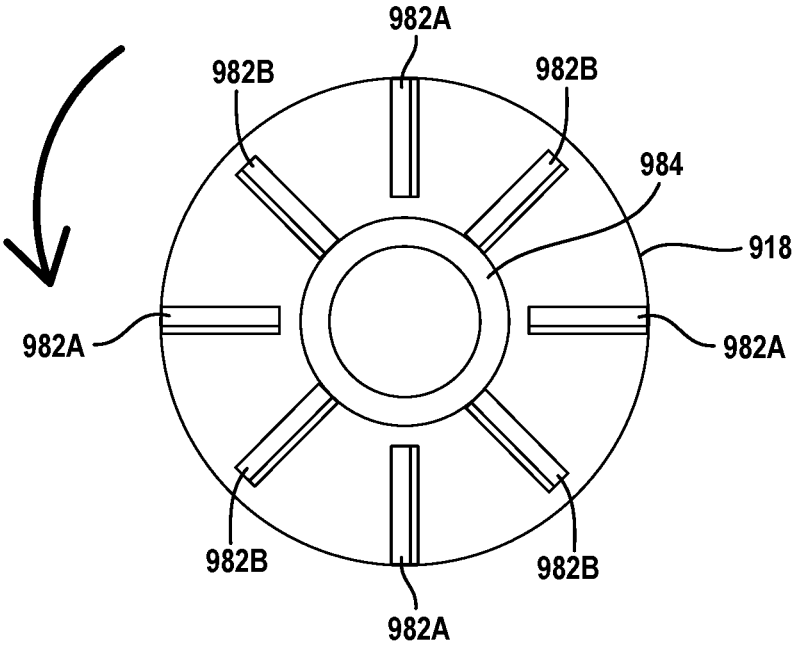
FIG. 8B is a front view of the balance disk of FIG. 8A.

Referring now to FIG. 8B, to increase the thrust force, hydrodynamic action of the balance disk 918 may be used. The balance disk 918 may be provided with a plurality of radially oriented surface recesses that generate hydrodynamic lift that increases in strength as the gap between the balance disk and the adjacent bearing face decreases. In this example, a first plurality of recesses 982A extends from the outer periphery of the balance disk 918 to just short of a groove 984. The groove 984 is a reduced thickness portion. It should be noted that each surface 918A, 918B of the balance disk may include such surfaces. However, only one surface in various designs may be used. The recesses 982B extend from the groove 984 to just short of the outer periphery of the balance disk 918. The recesses 982A and 982B are interspersed. That is, when traversing around the balance disk 918, the recesses 982A alternate with recesses 982B. In this example, there are four recesses 982A and four recesses 982B.

Figure 8C:
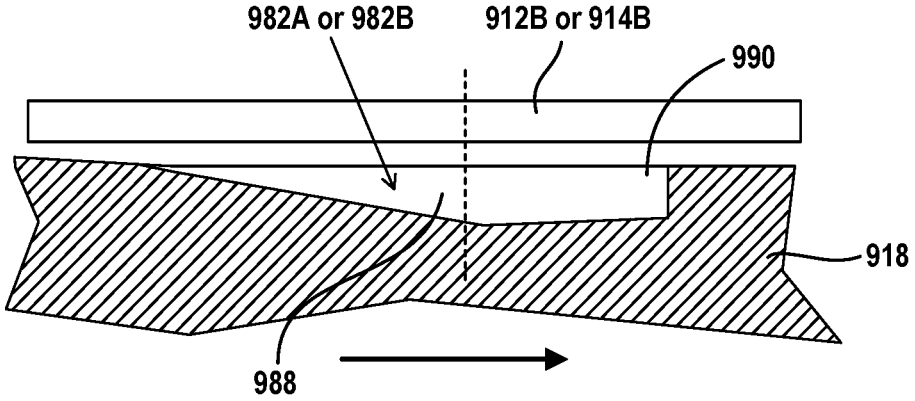
FIG. 8C is a cross-sectional view of the balance disk relative to a bearing surface of FIG. 8A.

Referring now to FIG. 8C, a cross-sectional view of the balance disk relative to one of the surfaces 912B or 914B is set forth. In this example, the balance disk is moving in the direction indicated by the arrow 986. Each of the recesses 982A or 982B may be formed according to the following. The recesses 982A or 982B include a tapered portion 988. The groove 990 is on the leading edge and thus pressure is built up in the tapered portion 988 due to the movement of the balance disk 918 in the direction indicated by the arrow 986.

Because the lubrication flow to the thrust bearings are filtered, the clearance between the surfaces 912B or 914B and the balance disk 918 may be small. The clearance is smaller than the distance between the wear rings 232.

Figure 8D:
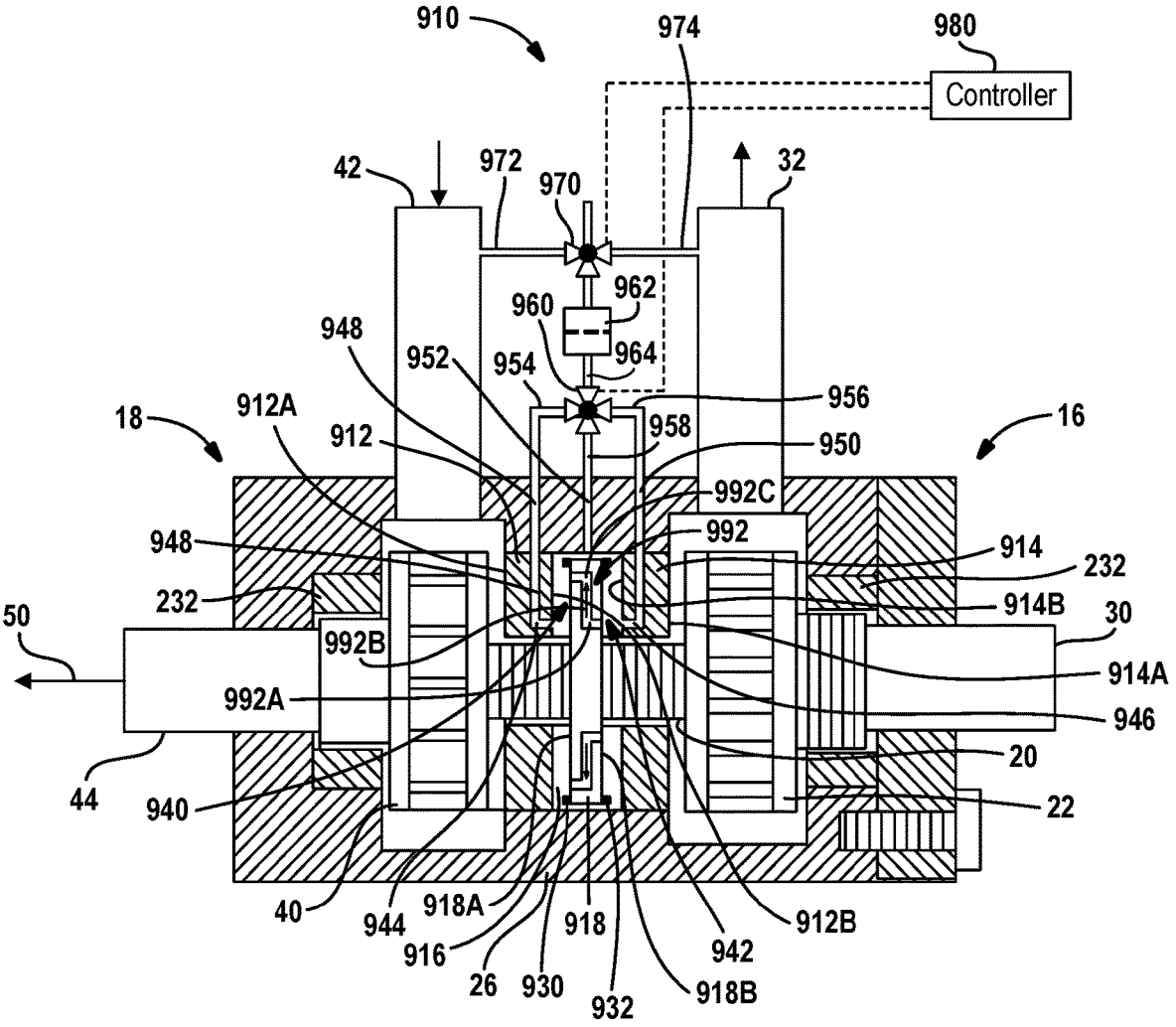
FIG. 8D is a cross-sectional view of a second example according to the present disclosure.

Referring now to FIG. 8D, the balance disk 918 includes a flow channel 992 therethrough. The flow channel 992 extends within the balance disk 918 and communicates fluid from a first side of the balance disk to a second side of the balance disk 918. In FIG. 8D, fluid is communicated from the pump side or surface 918B of the balance disk 918 to the turbine side or surface 918A of the balance disk 918.

The flow channel 992 has a first axial portion 992A that extends from the pump side 918B proximate to or adjacent to the shaft 20. A radial portion 992B extends in a radial direction from the first axial portion 992A. The radial portion 992B extends away from the shaft 20 in a radial direction. A second axial portion 992C couples the radial portion 992B to the second side of the balance disk 918.

In operation, fluid flows from the first side or surface 918A of the balance disk 918 which corresponds to the pump side through the first axial portion 992A, through the radial portion 992B where the centrifugal forces cause an increase in the pressure of the fluid. The centrifugal force is caused by the high rate of rotation of the shaft 20 and the rotor associated therewith. Fluid exits to the second surface 918B of the balance disk 918 through the second axial portion 992C into the thrust bearing formed on the first surface 918A. The second axial portion 992C is located a further distance from the shaft 20 than the first axial portion 992A (radially outward). The flow channel 992 consequently increases the capacity of the thrust bearing at the turbine side of the balance disk 918.

It should be noted that a plurality of flow channels may be included in the balance disk. To provide balanced forces, the flow channels may be symmetrically disposed about the balance disk 918. It should also be noted that in FIG. 8D, the thrust forces that act on the shaft are in the direction toward the turbine side.

Figure 8E:
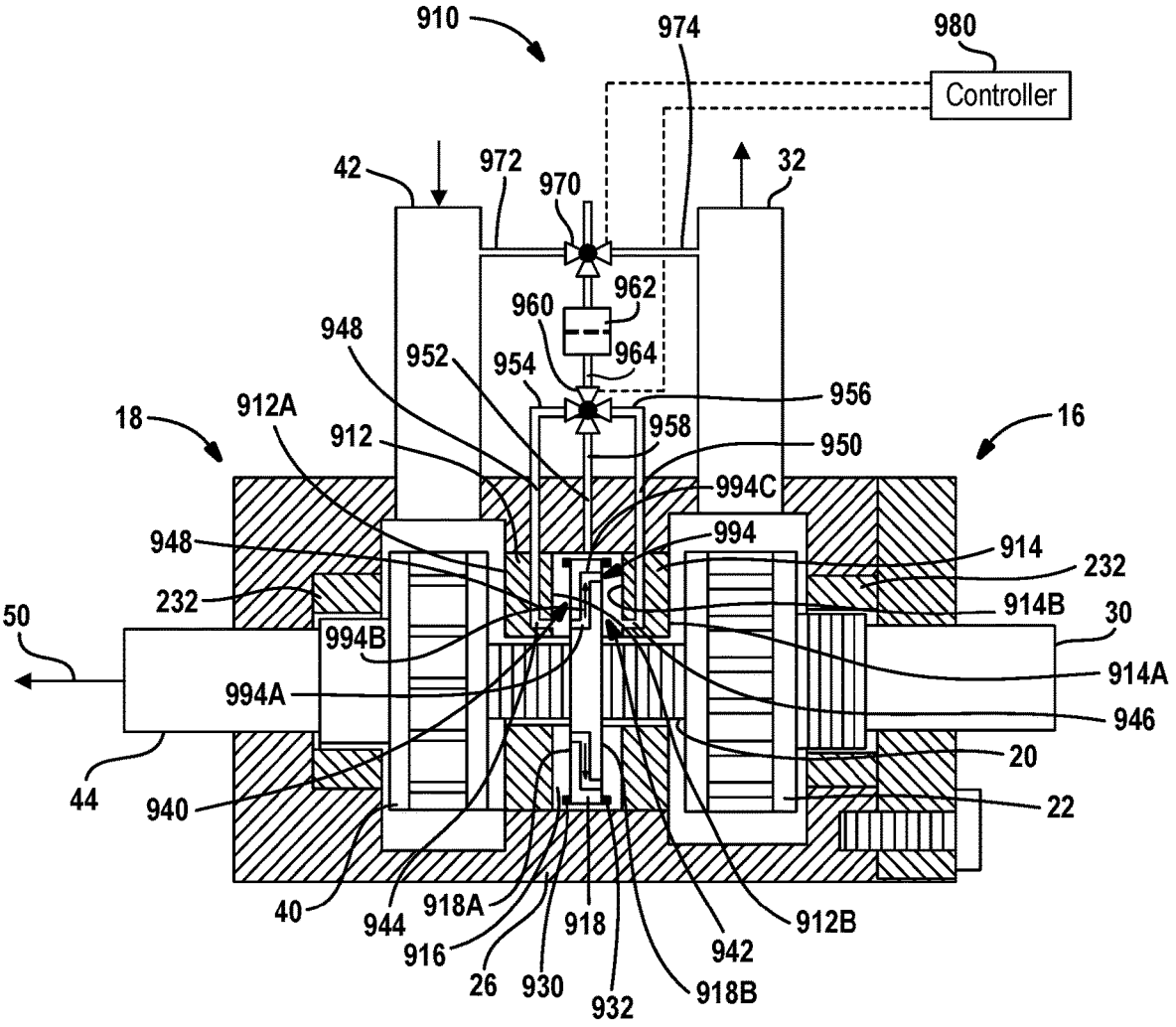
FIG. 8E is a cross-sectional view of a third example according to the present disclosure

Referring now to FIG. 8E, another embodiment of a flow channel within a balance disk 918 is set forth in a similar manner as that of FIG. 8D. However, in FIG. 8E, the predominant forces are in the direction of the pump portion 16. Therefore, a flow channel 994 is communicating fluid from the first surface 918A of the balance disk which corresponds to the turbine portion to the second surface 918B of the balance disk which corresponds to the pump side of the balance disk 918. In this example, the flow channel 994 includes a first axial portion 994A that is fluidically coupled to the first surface 918A of the balance disk 918. A radial portion 994B communicates fluid from the first axial portion 994A to a second axial portion 994C. The second axial portion 994C communicates fluid to the second surface 918B of the balance disk. In a similar manner to that described above with respect to FIG. 8D, fluid enters the first axial portion 994A adjacent to or proximate to the shaft 20. The pressure of the fluid within the flow channel 994 is increased by the centrifugal forces acting on the rotating balance disk 918. The fluid pressure increases within the radial portion 994B as the fluid traverses in the direction illustrated by the arrow toward the outward direction of the balance disk 918 away from the shaft 20. Higher pressure fluid then enters the thrust bearing located at the pump side of the balance disk 918. As mentioned above, the increased high pressure fluid into the thrust bearing increases the capacity of the thrust bearing, in this case, on the pump side of the hydraulic pressure booster 910.

Figure 9:
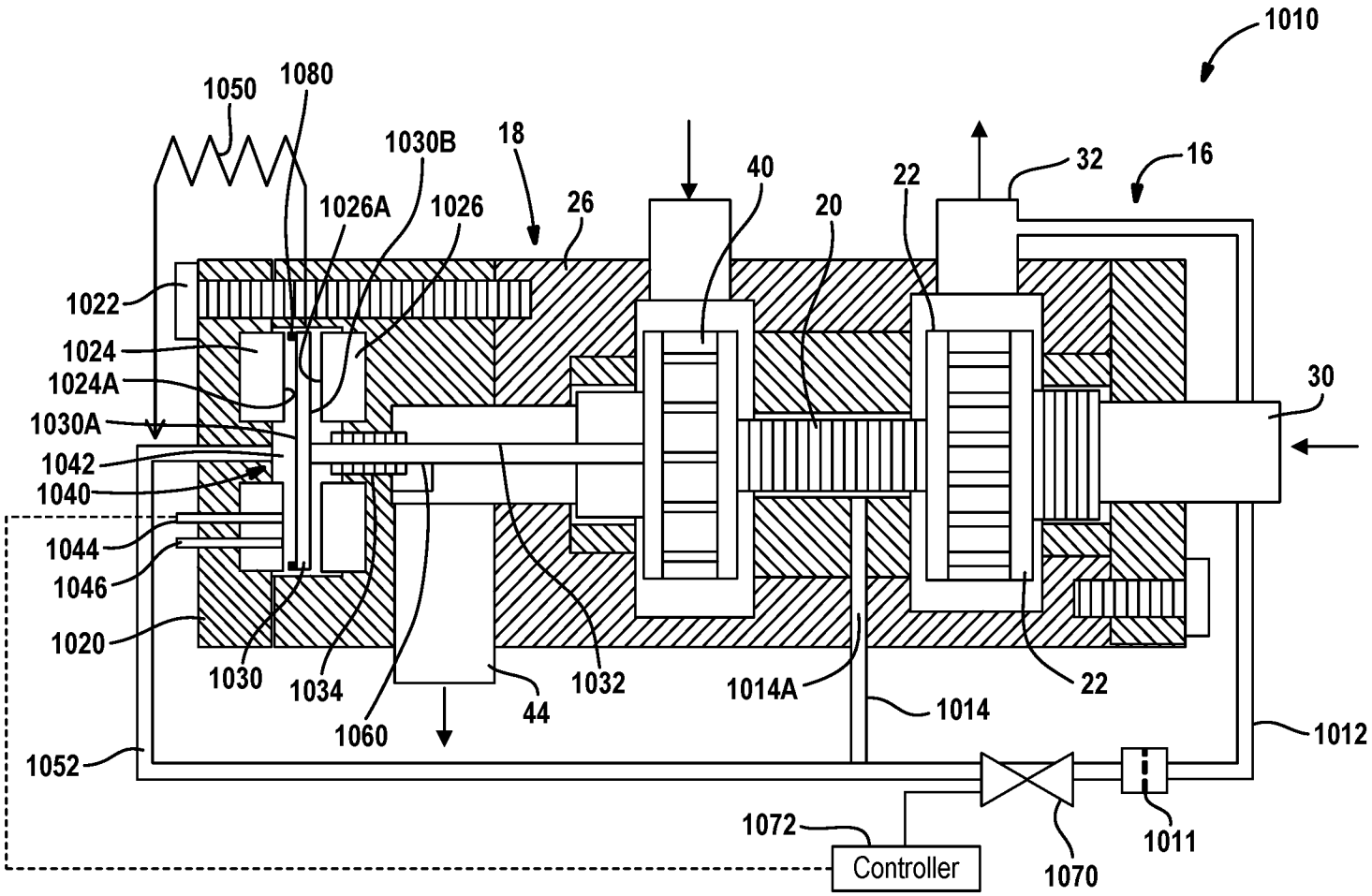
FIG. 9 is a fourth example of a hydraulic pressure booster according to the disclosure.

Referring now to FIG. 9, an alternative fluid machine 1010 is set forth. In this example, fluid is communicated from the pump outlet 32 to the filter 1011 disposed within a pipe 1012. A pipe 1014 may communicate fluid from the pump outlet to the shaft 20 between the turbine portion 18 and the pump portion 16 of the fluid machine 1010 such as a hydraulic pressure booster. In this example, the balance disk 1030 and balance disk chamber 1042 have been relocated outboard and adjacent to the turbine portion 18 of the fluid machine. The casing 26 may be supplemented with a casing extension or outer cap 1020 that is fastened with a bolt 1022 to a turbine end of the casing 26. The casing 26 and the outer cap 1020 may have a hollow space therebetween to house a first bearing 1024 and a second bearing 1026. The bearings 1024 and the bearings 1026 have inner surfaces 1024A and 1026A, respectively. The surface 1024A may form thrust bearing 1040 between surfaces 1030A of the balance disk 1030 within the volume defined by the wear ring 1080 disposed on the surface 1030A.

The flow channels 992, 994 illustrated in the balance disks illustrated in FIGS. 8D and 8E may also be incorporated within the balance disk 1030 to increase the capacity of the thrust bearings 1040.

A shaft extension 1032 may extend from the turbine portion 18 and the shaft 20 so that the balance disk 1030 and the wear ring 1080 rotates therewith. A shaft seal 1034 seals the shaft extension 1032 from leakage with the turbine outlet 44. The turbine outlet 44 is perpendicular to the shaft 20.

The pipe 1014 and the channel 1014A are provided closer to the pump impeller 22 than the turbine impeller 40. That is, the distance between the pump impeller 22 and the channel 1014A is less than the distance between the channel 1014A and the turbine impeller 40.

In operation, the rate of flow to the thrust bearing 1040 formed by a volume within the balance disk chamber 1042 between the outer cap 1020 of the bearing casing, the balance disk 1030 and wear ring 1080 is very low since the only passage into the thrust bearing volume is through the shaft seal 1034.

A temperature sensor 1044 and a proximity sensor 1046 may be disposed within the bearing 1024 to generate a temperature signal corresponding to a temperature at the bearing 1024 and a proximity signal of the balance disk 1030 relative distance to the bearing 1024. The output of the temperature sensor 1044 may be used to control the heat exchanger 1050 and thus cool the fluid within the thrust bearing 1040. The fluid from the thrust bearing 1040 may be communicated through the heat exchanger 1050 and to the inlet pipe 1052 in a cooled state. The circulation through the heat exchanger 1050 is driven by the higher pressure caused by the rotating balance disk 1030. That is, a higher pressure exists at the outer diameter of the balance disk 1030 and thus the fluid may be communicated through the heat exchanger and back through the inlet pipe 1052.

The speed sensor 1060 may be used to monitor the rotational speed of the shaft extension 1032 which also corresponds to the rotational speed of the shaft 20. The speed sensor 1060 may be located within the turbine outlet 44 or adjacent to the temperature sensor 1044 and the proximity sensor 1046. A tooth or other indicator on the balance disk may provide the sensor with the rotational speed of the shaft.

Figure 10:
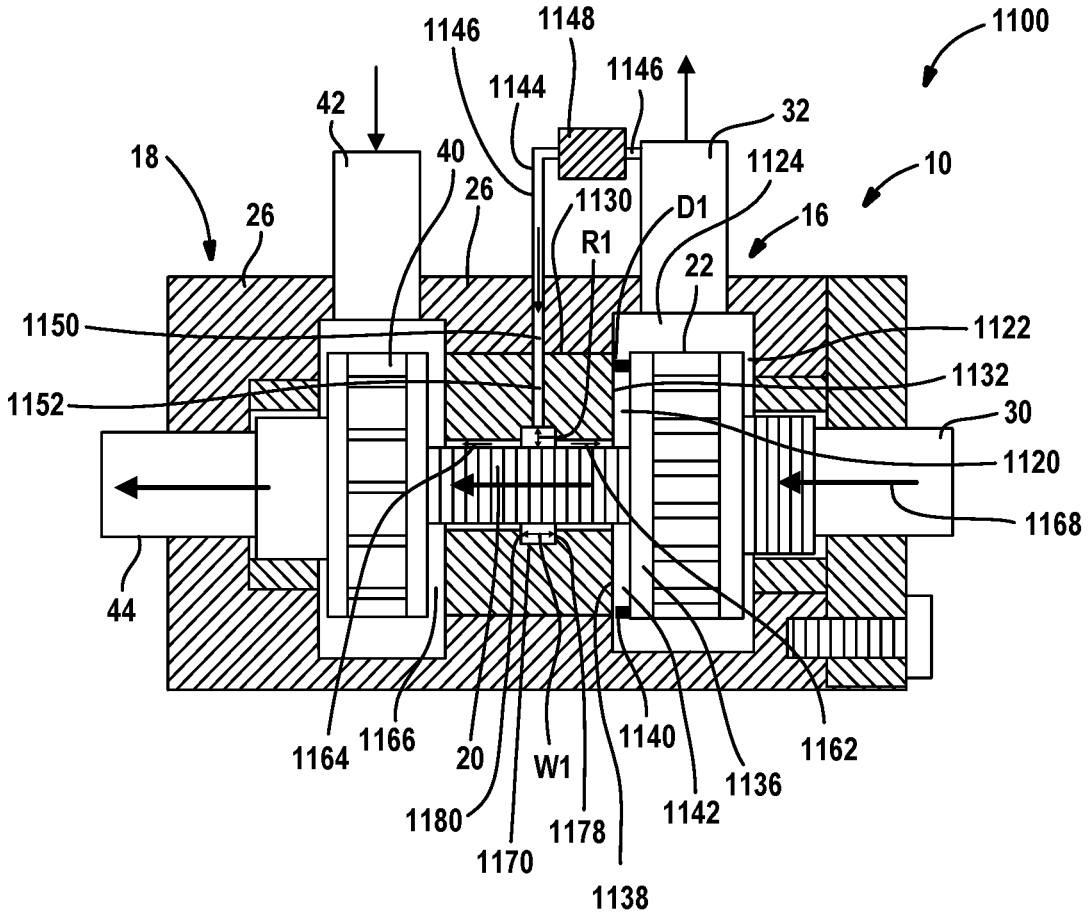
FIG. 10 is a fifth example of a hydraulic pressure booster according to the disclosure.

Referring now to FIG. 10, another example of a hydraulic pressure booster 1100 is set forth. The same components from the above examples use the same reference numerals. In the following example, the balance disk is eliminated. In this example, a thrust bearing 1120 is formed within the pump cavity 1122. The pump cavity 1122 also includes a volute 1124. The casing 26 has a center bearing 1130 disposed therein. The center bearing 1130 extends between the pump portion 16 and the turbine portion 18. The center bearing 1130 has an end surface that forms a stationary thrust face 1132. The shaft 20 extends through and is normal to the thrust face extends around the shaft 20.

The pump impeller 22 has a shroud 1136 that is generally cylindrical in shape and has an end surface 1138. The end surface 1138 of the shroud 1136 rotates together with the shaft 20. In this example, a land 1140 is disposed on the end surface 1138 of the shroud 1136. The land 1140 thus rotates with the shroud 1136 and the pump impeller 22. Of course, the land 1140 may be disposed on the center bearing 1130 and in particular the end surface (thrust face 1132) of the center bearing 1130. As illustrated, the gap or distance between the end of the land 1140 and the stationary thrust face 1132 of the center bearing 1130 is $D_1$. As will be further described below, various operating conditions may cause the gap $D_1$ to vary.

A thrust bearing cavity 1142 of the thrust bearing 1120 is defined between the end surface 1138, the stationary thrust face 1132, the land 1140 and the shaft 20. Ultimately, clean fluid from the pump outlet 32 is communicated to the thrust bearing cavity 1142.

A feed supply 1144 fluidically communicates fluid from the pump outlet 32 to the thrust bearing cavity 1142. The feed supply 1144 includes a pipe 1146 that has a filter 1148 disposed therein. The filter 1148 is used to filter the possibly contaminated outlet fluid of the pump outlet 32. The pipe 1146 is coupled to a channel 1150 that extends through the casing 26. A second channel 1152 through the center bearing 1130 is in fluid communication with the channel 1150 and the pipe 1146. The channels 1150 and 1152 extend in a radial direction toward the shaft 20 and are part of the feed supply 1144.

The center bearing 1130 includes a distribution groove 1160 disposed around the longitudinal axis of the center bearing 1130 and hydraulic pressure booster 1100. The groove 1160 has a width $W_1$ and a depth $R_1$ that corresponds to the distance from the shaft 20. The distribution groove 1160 is ring shaped and is around the shaft 20.

The distribution groove 1160 is fluidically coupled to both the pump portion 16 and the turbine portion 18 internal to the casing 26. More specifically, the distribution groove 1160 is in fluid communication with the thrust bearing cavity 1142 through a first bearing clearance 1162 in center bearing 1130. A second bearing clearance 1164 in the center bearing fluidically communicates fluid from the distribution groove 1160 to the turbine cavity 1166. The first bearing clearance 1162 and the second bearing clearance 1164 extend in an axial direction. In this example, the distribution groove 1160 is closer to the pump portion than the turbine portion. That is, the length of the first bearing clearance 1162 is less than the length of the second bearing clearance 1164.

In operation, a portion of the high pressure fluid that exits the pump outlet 32 is partially communicated through the pipe 1146 and through the filter 1148 of the feed supply 1144. Fluid from the pipe 1146 is communicated through the channels 1150 and 1152 of the feed supply 1144 into the distribution groove 1160. The fluid from the distribution groove 1160 is communicated both to the pump portion 16 and the turbine portion 18. In particular, fluid from the distribution groove 1160 is communicated through the first bearing clearance 1162 into the thrust bearing cavity 1142. Fluid from the distribution groove 1160 is also simultaneously communicated through the second bearing clearance 1164 and into the turbine cavity 1166. Fluid flowing through the bearing clearances 1162, 1164 provide lubrication and cooling to the center bearing 1130. Fluid entering the thrust bearing cavity 1142 is communicated through the distance $D_1$ between the end of the land 1140 and the stationary thrust face 1132 of the center bearing 1130.

The pressure within the thrust bearing cavity 1142 counteracts the natural force of the hydraulic pressure booster indicated by arrow 1168. When the gap $D_1$ increases, the pressure within the thrust bearing cavity 1142 is reduced and thus the land 1140 moves closer to the center bearing 1130. When the pressure within the thrust bearing cavity 1142 increases the gap $D_1$ and thus the pressure within the thrust bearing 1142 is reduced. Thus, movement of the pump impeller 22 and the land 1140 connected thereto restricts or increases the fluid flow between the land 1140 and the stationary thrust face 1132 of the center bearing 1130. In should be noted that the thrust bearing 1120 provides a counter thrust or force to the force indicated buy the arrow 1168. The flow of fluid from the thrust bearing cavity 1142 ultimately is communicated to the pump of volute 1124.

As mentioned above, in one constructed example the axial length of the first bearing clearance 1162 is less than the length of the second bearing clearance 1164. The length of the first bearing clearance 1162 and the second bearing clearance 1164 are related to the axial location of the distribution groove 1160. A shorter first bearing clearance 1162 results in the pressure within the thrust bearing cavity 1142 being higher. The "stiffness" of the thrust bearing 1120 increases with a longer first bearing clearance 1162. This is because the change in flow will result in a larger pressure change through the first bearing clearance 1162.

The volume of the distribution groove 1160 is defined between the shaft 20, the width $W_1$ and the depth $D_1$. The depth $D_1$ is terminated by the longitudinally extending wall 1170. The longitudinal width $W_1$ of the distribution groove 1160 is defined by the lateral walls 1178 and 1180. The volume of the distribution groove 1160 may be changed based upon various design and use considerations. The amount of flow between the land 1140 and the stationary thrust face 1132 of the center bearing 1130 is considered when sizing the distribution groove 1160. The flow of fluid between the land 1140 and the stationary thrust face 1132 changes based on axial movement of the shaft 20 and the pump impeller 22. The amount of flow through the gap $D_1$ in extreme operating conditions is compensated for by the amount of volume within the distribution groove 1160. That is, the amount of volume within the distribution groove 1160 may be sized to compensate for a rapid flow of fluid through the gap $D_1$. The volume of the distribution groove 1160 is capable of replacing rapidly lost volume within the thrust bearing cavity 1142. The volume within the distribution groove 1160 is thus a function of the thrust bearing cavity volume.

Another design consideration is the amount of volume within the thrust bearing cavity 1142. As the radial distance between the land 1140 and the shaft 20 increases, a greater amount of thrust may be accommodated.

Figure 11:
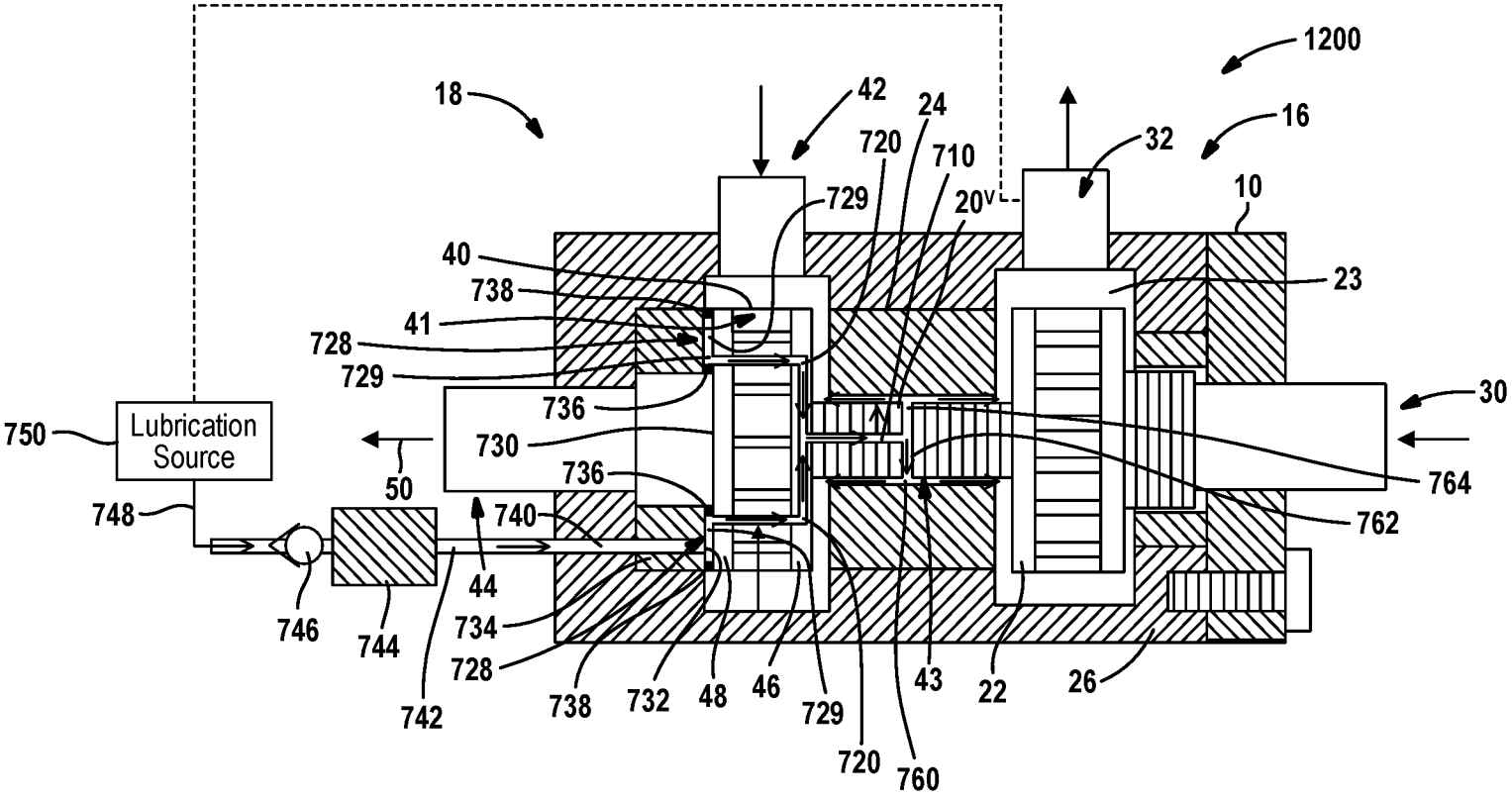
FIG. 11 is a sixth example of a hydraulic pressure booster according to the disclosure.

Referring now to FIG. 11, ultra-high pressure applications such as those involving hazardous fluids require a large flange between the pump and turbine impellers and thus long shafts are required to be used. Long shafts have reduced stiffness and require additional bearing area for support. This results in greater drag and a potential for rubbing. In this example, a hydraulic pressure booster 1200 has the thrust bearing 28 that receives fluid from the lubricant passage 740. In this example, the lubricant passage 740 extends in an axial direction through the casing 26. A pipe 742 fluidically communicates lubricant from a filter 744 to the lubricant passage 740. The filter removes particulates to protect the bearing surfaces from wear.

A check valve 746 disposed in a pipe 748 that fluidically communicates a lubrication source 750 with the filter 744 is set forth. The check valve 746 allows flow from the lubrication source 750 to reach the filter 744 but prevents flow in the opposite direction. That is, flow from the hydraulic pressure booster 1200 is prevented from leaving the thrust bearing cavity 729.

In the example set forth in FIG. 11, lubricant flows in the opposite direction as that illustrated in FIG. 7. The thrust bearing 728 is formed in a similar manner to that illustrated above with respect to FIG. 7 in that a thrust bearing 728 has a thrust bearing cavity 729 defined by the rotating thrust face 730, the stationary thrust face 732, the inner land 736 and the outer land 738. Lubricant flows from a lubrication source 750 through the lubricant passage 740 into the thrust bearing cavity 729. The lubricant passage 740 extends through an axial end 741 of the casing 26 at the axial end 741. As denoted in described lines, the lubricant source 750 may be the pump outlet 32 which may be filtered by filter 744. Lubricant flows from the thrust bearing cavity 729 into the axially extending passages 726 that are disposed within the vanes 724. Lubricant flows from the axially extending passages to the radially extending passages 720. Lubricant flows from the radially extending passages 720 to the center axial shaft passage 710 disposed within the shaft $20^{V}$. Fluid flows from the central axial shaft passage 710 of the shaft $20^{V}$ to a first radial shaft passage 762 and a second radial shaft passage 764. In this example, the first radial shaft passage 762 and the second radial shaft passage 764 are perpendicular to the center axial shaft passage 710.

A bearing clearance 760 is disposed between the center bearing 24 and the shaft $20^{IV}$. The bearing clearance 760 received fluid from both the first radial shaft passage 762 and the second radial shaft passage 764. The lubricant flows in an axial direction toward the pump impeller chamber 23 and the turbine impeller chamber 41. The lubricant prevents rubbing of the shaft with the center bearing 24 as well as provides cooling.

It should be noted that the location of the axially extending passages 726 are located close to the longitudinal axis LA of the hydraulic pressure booster 1200. This reduces the adverse centrifugal pressure gradient exerted in the radially extending passages 720.

One advantage of the system is that during start up and shut down, the pressure of lubrication flow passing through the inlet pipe 42 of the turbine portion 18 may be insufficient for lubricated the rotor. The check valve 746 prevents lubricant fluid from leaving the casing and the thrust bearing cavity 729. This prevents contaminated fluid from entering the bearing cavity 729 from the turbine impeller chamber 41. In normal start up, the rotor 43 comes up to speed in a matter of a few seconds and thus the prevention of backflow or reverse flow through the lubricant passage 740 avoids damage until normal lubrication flow is established.

Figure 12A:
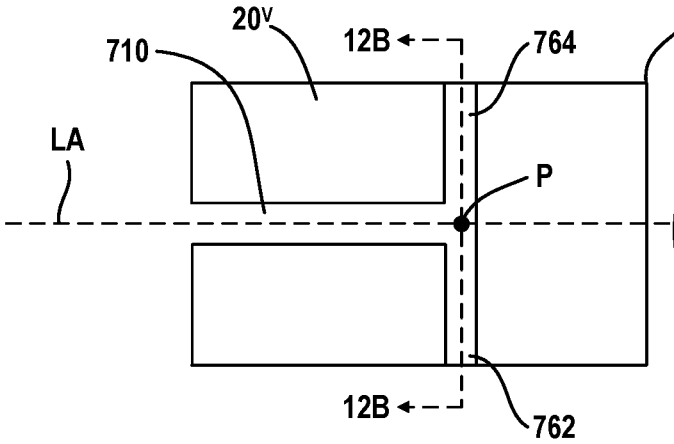
FIG. 12A is an axial cross-sectional view of channel in a shaft of first example for use in FIG. 11.
Figure 12B:
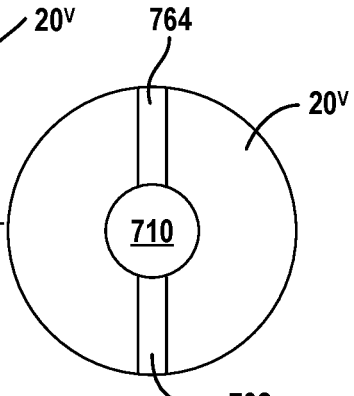
FIG. 12B is a radial cross-sectional view of channel in a shaft of first example for use in FIG. 11.

Referring now to FIGS. 12A and 12B, the shaft $20^{VI}$ is illustrated in further detail. In this example, the first radial shaft passage 762 and the second radial shaft passage 764 are illustrated in further detail. The example set forth in FIGS. 12A and 12B are suitable for many conditions. However, because the first radial shaft passage 762 and the second radial shaft passage 764 are disposed in the same cross-sectional plane, a weakening of the shaft might take place. That is, the first radial shaft passage 762 and the second radial shaft passage 764 intersect the center axial shaft passage at point P.

Figure 12C:
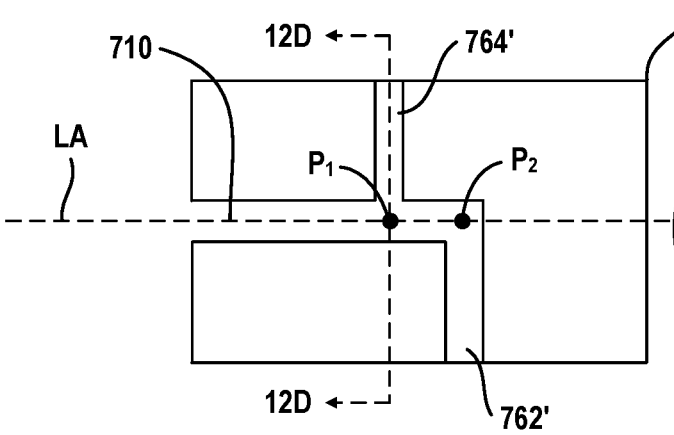
FIG. 12C is an axial cross-sectional view of channel in a shaft of second example for use in FIG. 11.
Figure 12D:
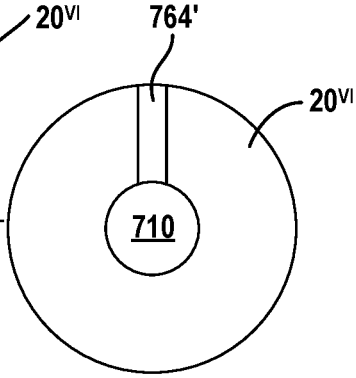
FIG. 12D is a radial cross-sectional view of channel in a shaft of second example for use in FIG. 11.

Referring now to FIGS. 12C and 12D, the first radial shaft passage 762' and the second radial shaft passage 764' intersect the central axial shaft passage at different locations. That is, the intersection of the center axial shaft passage 710 and the intersections P1 and P2 the first radial shaft passage 762' is P2 and the second radial shaft passage 764' is P2 are offset in a longitudinal direction to increase the strength of the rotating shaft $20^{VII}$.

Figures 12E, 12F:
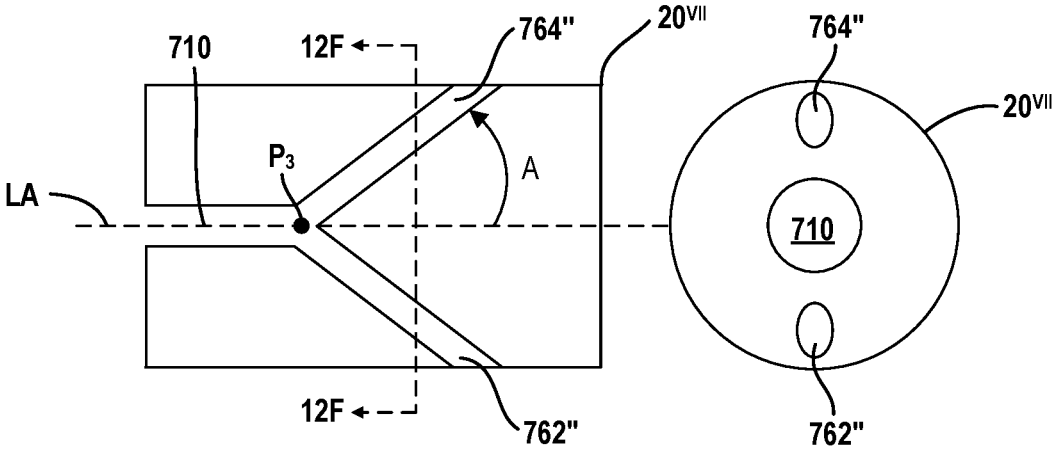
FIG. 12E is an axial cross-sectional view of channel in a shaft of third example for use in FIG. 11.
FIG. 12F is a radial cross-sectional view of channel in a shaft of third example for use in FIG. 11.

Referring now to FIGS. 12E and 12F, the first radial shaft passage 762''' and the second radial shaft passage 764''' are disposed in an angular direction relative to the longitudinal axis LA of the shaft $20^{VII}$. In this example, the angle A relative to the longitudinal axis LA of the shaft $20^{VII}$ is about 45 degrees. In this example, the center axial shaft passage 710 and the first radial passage shaft passage 762'' and the second radial shaft passage 764'' intersect at a common point P3.

Figures 12G, 12H:
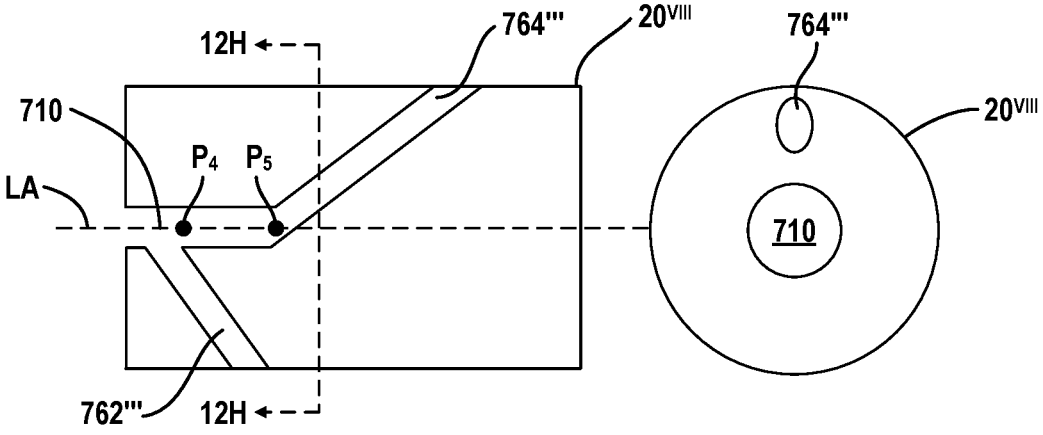
FIG. 12G is an axial cross-sectional view of channel in a shaft of fourth example for use in FIG. 11.
FIG. 12H is a radial cross-sectional view of channel in a shaft of fourth example for use in FIG. 11.

Referring now to FIGS. 12G and 12H, the intersection of the center axial shaft passage 710 and the first radial shaft passage 762''' is P4 and the second radial shaft passage 764''' is P5. The intersection points P4 and P5 are offset in a longitudinal direction. This is believed to increase the strength of the shaft 20$^{IV}$.

In FIGS. 12E-12H a 45 degree angle is illustrated. However, various angles between about 30 and about 60 degrees relative to the longitudinal axis LA of the shaft 20$^{VIII}$ may be provided. It is believed that the shaft 20$^{VIII}$ illustrated in FIG. 12G provides the strongest shaft arrangement because two angled channels are axially staggered to eliminate overlap in any radial plane. The intersection of the radial shaft passages 762, 764 with the control axial shaft 760 are off set at points P4 and P5.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A fluid machine assembly comprising:

a pump portion having a pump impeller chamber, a pump inlet and a pump outlet;

a turbine portion having a turbine impeller chamber, a turbine inlet and a turbine outlet;

a center bearing disposed between the pump impeller chamber and turbine impeller chamber, said center bearing having a first end surface defining a stationary thrust face within the pump impeller chamber;

a shaft extending between the pump impeller chamber and the turbine impeller chamber through the center bearing;

a turbine impeller coupled to the shaft disposed within the turbine impeller chamber;

a pump impeller coupled to the shaft and disposed within the pump impeller chamber, said pump impeller comprising a rotating thrust face opposite the stationary thrust face;

a land disposed between the stationary thrust face and the rotating thrust face;

said center bearing defining a distribution groove disposed at least partially around the shaft;

a feed supply coupling the pump outlet to the distribution groove;

a thrust bearing comprising a thrust bearing cavity defined between the stationary thrust face, the rotating thrust face and the land, said thrust bearing receiving filtered fluid from the pump outlet;

a first bearing clearance between the center bearing and the shaft fluidically coupling the distribution groove to the thrust bearing cavity in a first axial direction; and a second bearing clearance between the center bearing and the shaft fluidically coupling the distribution groove to the turbine impeller chamber in a second axial direction opposite the first axial direction.

2. The fluid machine assembly as recited in claim 1 further comprising a filter filtering fluid between the pump outlet and the thrust bearing.

3. The fluid machine assembly as recited in claim 1 further comprising a filter filtering fluid between the pump outlet and the distribution groove.

4. The fluid machine assembly as recited in claim 1 wherein the land is disposed adjacent an outer periphery of the rotating thrust face.

5. The fluid machine assembly as recited in claim 1 wherein the distribution groove is located closer to the pump impeller than the turbine impeller.

6. The fluid machine assembly as recited in claim 1 wherein the first bearing clearance comprises a first length and the second bearing clearance comprises a second length, said first length less than the second length.

7. The fluid machine assembly as recited in claim 1 wherein the distribution groove comprises a volume and wherein the volume is a function of the thrust bearing cavity.

8. The fluid machine assembly as recited in claim 1 wherein the distribution groove comprises a volume and wherein the volume is a function of axial movement of the pump impeller and the thrust bearing cavity.

9. The fluid machine assembly as recited in claim 1 wherein the land is disposed on an end surface of the pump impeller.

10. The fluid machine assembly as recited in claim 1 wherein the first bearing clearance and the second bearing clearance extend axially through the center bearing.

11. The fluid machine assembly as recited in claim 1 wherein the feed supply comprises a first channel through a casing and a second channel through the center bearing.

12. The fluid machine assembly as recited in claim 1 wherein the feed supply comprises a first channel through a casing, a second channel through the center bearing, a pipe coupled to the pump outlet and a filter coupled to the pipe.

13. A method of operating a fluid machine comprising:

communicating fluid from a pump outlet to a distribution groove disposed in a center bearing;

communicating fluid in a first axial direction from the distribution groove to a thrust bearing through a first bearing clearance between a shaft and the center bearing, said thrust bearing formed between a stationary end surface of a center bearing and an end surface of a pump shroud that is coupled to the shaft;

simultaneously with communicating fluid in the first axial direction from the distribution groove to the thrust bearing, communicating fluid from the distribution groove to a turbine impeller chamber in a second axial direction opposite the first axial direction;

rotating the shaft to generate a first axial force; and generating a second axial force counter to the first axial force in response to communicating fluid from the distribution groove to the thrust bearing.

14. The method as recited in claim 13 further comprising, communicating fluid from the thrust bearing to a pump volute after communicating fluid from the distribution groove to the thrust bearing.

15. The method as recited in claim 13 wherein communicating fluid from the pump outlet to the distribution groove comprises communicating fluid through a filter to the distribution groove.

16. The method of claim 13 wherein communicating fluid from the distribution groove to the thrust bearing comprises communicating fluid into a thrust bearing cavity defined by the stationary end surface of the center bearing, the end surface of the pump shroud and a land.

17. The method of claim 16 wherein rotating the shaft comprises rotating the pump shroud and the land.

18. A fluid machine assembly comprising:

a casing comprising a pump portion having a pump impeller chamber, a pump inlet and a pump outlet;

a pump impeller disposed in the pump impeller chamber;

said casing further comprising a turbine portion having a turbine inlet, a turbine outlet and a turbine impeller chamber;

a turbine impeller disposed in the turbine impeller chamber, said turbine impeller comprising a turbine shroud comprising a rotating thrust face;

a shaft extending between the pump impeller and the turbine impeller, said shaft comprising a center axial shaft passage, a first radial shaft passage and a second radial shaft passage;

a turbine wear ring disposed around the turbine outlet comprising a stationary thrust face opposite the rotating thrust face;

a center bearing disposed around the shaft between the pump impeller chamber and turbine impeller chamber, said center bearing and the shaft comprising a bearing clearance therebetween;

a land disposed between the stationary thrust face and the rotating thrust face;

a thrust bearing comprising a thrust bearing cavity defined between the stationary thrust face, the rotating thrust face and the land, said thrust bearing receiving filtered fluid from the pump outlet;

a lubricant supply coupling lubricant to the thrust bearing cavity; and an impeller passage communicating lubricant from the thrust bearing cavity to the center axial shaft passage;

said center axial shaft passage communicating lubricant to said bearing clearance through the first radial shaft passage and the second radial shaft passage;

said bearing clearance communicating lubricant to the pump impeller chamber and the turbine impeller chamber.

19. The fluid machine assembly as recited in claim 18 wherein the casing comprises a lubricant passage fluidically coupled to the thrust bearing cavity and communicating lubricant from the lubricant supply to the thrust bearing cavity.

20. The fluid machine assembly as recited in claim 19 wherein the lubricant passage extends axially through an axial end surface of the turbine portion.

21. The fluid machine assembly as recited in claim 19 further comprising a check valve disposed in a lubricant pipe between the lubricant supply and the lubricant passage.

22. The fluid machine assembly as recited in claim 18 wherein the impeller passage comprises an axially extending passage and a radially extending passage, said radially extending passage in fluid communication with the axially extending passage.

23. The fluid machine assembly as recited in claim 18 wherein the first radial shaft passage and the second radial shaft passage extend perpendicular to the center axial shaft passage.

24. The fluid machine assembly as recited in claim 18 wherein the first radial shaft passage and the second radial shaft passage intersect the center axial shaft passage at different points that are axially offset.

25. The fluid machine assembly as recited in claim 18 wherein the first radial shaft passage and that second radial shaft passage extend angularly from the center axial shaft passage at an angle between about 30 degrees and 60 degrees from a longitudinal axis of the casing.

26. The fluid machine assembly as recited in claim 18 wherein the first radial shaft passage and the second radial shaft passage extend perpendicular to the center axial shaft passage and intersect the center axial shaft passage at different points that are offset axially.

27. A method comprising:

communicating lubricant to a thrust bearing cavity disposed between a turbine impeller and a thrust wear ring;

communicating lubricant from the thrust bearing cavity to a center axial shaft passage of a shaft through an impeller passage of the turbine impeller;

communicating lubricant through the center axial shaft passage to a bearing clearance between a shaft and a center bearing through a first radial shaft passage and a second radial shaft passage; and communicating lubricant through the bearing clearance to a pump impeller chamber and a turbine impeller chamber.

28. The method as recited in claim 27 wherein communicating lubricant to the thrust bearing cavity comprises communicating lubricant from a lubricant supply to the thrust bearing cavity.

29. The method as recited in claim 27 wherein communicating lubricant to the thrust bearing cavity comprises communicating lubricant from a lubricant supply to the thrust bearing cavity through a lubricant passage disposed in axial end of a turbine portion.

30. The method as recited in claim 27 wherein communicating lubricant to the thrust bearing cavity comprises communicating lubricant from a lubricant supply to the thrust bearing cavity through a filter.

31. The method as recited in claim 27 wherein communicating lubricant through the center axial shaft passage comprises communicating lubricant through the center axial shaft passage to said bearing clearance through a first radial shaft passage and a second radial shaft passage extending perpendicular to the center axial shaft passage.

32. The method as recited in claim 31 wherein the first radial shaft passage and the second radial shaft passage intersect the center axial shaft passage at points that are axially offset.

33. The method as recited in claim 27 wherein communicating fluid through the center axial shaft passage comprises communicating lubricant through the center axial shaft passage to said bearing clearance through a first radial shaft passage and a second radial shaft passage extending angularly from the center axial shaft passage.

34. The method as recited in claim 33 wherein the first radial shaft passage and the second radial shaft passage intersect the center axial shaft passage axially offset.

35. The method as recited in claim 27 wherein communicating fluid through the center axial shaft passage comprises communicating lubricant through the center axial shaft passage to said bearing clearance through a first radial shaft passage and a second radial shaft passage extending angularly from the center axial shaft passage at an angle between about 30 degrees and about 60 degrees from a longitudinal axis.

* * * * *